US011747070B2

(12) United States Patent
Jung

(10) Patent No.: US 11,747,070 B2
(45) Date of Patent: Sep. 5, 2023

(54) ICE MAKER

(71) Applicant: Samsung Electronics Co., Ltd., Suwon-si (KR)

(72) Inventor: Moongyo Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/545,893

(22) Filed: Dec. 8, 2021

(65) Prior Publication Data

US 2022/0099348 A1 Mar. 31, 2022

Related U.S. Application Data

(63) Continuation of application No. 16/283,541, filed on Feb. 22, 2019, now Pat. No. 11,221,169.

(30) Foreign Application Priority Data

Feb. 26, 2018 (KR) ..... 10-2018-0022638

(51) Int. Cl.
*F25C 1/25* (2018.01)
*F25C 5/04* (2006.01)

(52) U.S. Cl.
CPC ..... *F25C 5/04* (2013.01); *F25C 1/25* (2018.01); *F25C 2400/10* (2013.01); *F25C 2600/04* (2013.01)

(58) Field of Classification Search
CPC ..... F25C 5/04; F25C 1/18; F25C 1/25; F25C 2400/10; F25C 2600/04
See application file for complete search history.

(56) References Cited

U.S. PATENT DOCUMENTS 3,952,539 A 4/1976 Hanson et al.
4,627,946 A 12/1986 Crabtree
(Continued)

FOREIGN PATENT DOCUMENTS

CN 105683688 A 6/2016
CN 107631528 A 1/2018
(Continued)

OTHER PUBLICATIONS

European Search Report dated Jun. 17, 2019, in connection with European Application No. EP19159157.7, 5 pages.
(Continued)

*Primary Examiner* — Miguel A Diaz

(57) ABSTRACT

An ice maker of a refrigerator includes a water supply to supply an ice-making water. The ice maker also includes an ice making container to be filled with the ice-making water. The ice maker further includes a cooler to provide a chill to the ice-making water. The ice maker additionally includes a water supplying-ice separator including at least one ice separating rod and a water supplying shaft. The water supplying shaft includes a water passage therein and a plurality of outlets wherein the ice-making water is discharged through the plurality of outlets to the ice making container. The at least one ice separating rod is provided on the water supplying shaft. The ice maker also includes a driver configured to rotate the water supplying-ice separator. The ice maker additionally includes a controller to control the driver, so that the at least one ice separating rod separates the ice.

20 Claims, 22 Drawing Sheets

(56) References Cited

U.S. PATENT DOCUMENTS

| | | | | |
|---|---|---|---|---|
| 8,919,145 | B2 | 12/2014 | Bortoletto et al. | |
| 8,950,197 | B2 | 2/2015 | Bortoletto et al. | |
| 9,151,527 | B2 | 10/2015 | Boarman et al. | |
| 9,200,823 | B2 | 12/2015 | Boarman et al. | |
| 9,470,448 | B2 * | 10/2016 | Culley | F25C 1/04 |
| 10,969,152 | B2 | 4/2021 | Yoon et al. | |
| 2005/0193759 | A1 | 9/2005 | Brunner et al. | |
| 2006/0016205 | A1 | 1/2006 | Tremblay et al. | |
| 2006/0137382 | A1 | 6/2006 | Sasaki et al. | |
| 2008/0022711 | A1 | 1/2008 | Brunner et al. | |
| 2008/0034780 | A1 | 2/2008 | Lim et al. | |
| 2012/0324917 | A1 | 12/2012 | Bortoletto et al. | |
| 2012/0324919 | A1 | 12/2012 | Bortoletto et al. | |
| 2013/0081412 | A1 | 4/2013 | Son et al. | |
| 2014/0165598 | A1 | 6/2014 | Boarman et al. | |
| 2014/0165599 | A1 | 6/2014 | Boarman et al. | |
| 2014/0165611 | A1 | 6/2014 | Boarman et al. | |
| 2014/0165620 | A1 | 6/2014 | Culley | |
| 2014/0167321 | A1 | 6/2014 | Culley et al. | |
| 2016/0245574 | A1 | 8/2016 | Jeong et al. | |
| 2018/0017307 | A1 | 1/2018 | Jeong et al. | |
| 2018/0216862 | A1 | 8/2018 | Junge et al. | |
| 2018/0231294 | A1 | 8/2018 | Song et al. | |
| 2019/0093934 | A1 | 3/2019 | Mor | |
| 2019/0338995 | A1 | 11/2019 | Bertolini et al. | |
| 2020/0158410 | A1 | 5/2020 | Kim et al. | |
| 2023/0112446 | A1 * | 4/2023 | Zhou | F25C 5/08 62/353 |

FOREIGN PATENT DOCUMENTS

| | | | |
|---|---|---|---|
| JP | 2006-183944 | A | 7/2006 |
| JP | 2006-230516 | A | 9/2006 |
| JP | 4546284 | B2 | 9/2010 |
| JP | 4657707 | B2 | 3/2011 |
| KR | 10-2005-0105819 | A | 11/2005 |
| KR | 10-0673715 | B1 | 1/2007 |
| KR | 10-2007-0119271 | A | 12/2007 |
| KR | 10-2008-0014598 | A | 2/2008 |
| KR | 10-2018-0007535 | A | 1/2018 |
| WO | 2012077972 | A2 | 6/2012 |

OTHER PUBLICATIONS

International Search Report and Written Opinion of the International Searching Authority dated Jun. 19, 2019, in connection with International Application No. PCT/KR2019/002270, 11 pages.

Notification of the First Office Action dated Oct. 27, 2021, in connection with Chinese Application No. 20198000697.X, 16 pages.

Office Action dated Mar. 15, 2022, in connection with Korean Application No. 10-2018-0022638, 14 pages.

* cited by examiner

ICE MAKER

CROSS-REFERENCE TO RELATED APPLICATIONS

This application is a continuation of application Ser. No. 16/283,541, filed Feb. 22, 2019, which is based on and claims priority under 35 U.S.C. § 119 to Korean Patent Application No. 10-2018-0022638, filed on Feb. 26, 2018, in the Korean Intellectual Property Office, the disclosures of which are incorporated by reference herein in their entirety.

BACKGROUND

1. Field

The disclosure relates to an ice maker of a refrigerator, which can make ice.

2. Description of the Related Art

A refrigerator including an ice maker refers to an apparatus that employs a refrigeration cycle to store things at a low temperature by supplying a chill to a storage compartment, and make ice by supplying a chill to the icemaker.

The icemaker of the refrigerator is kept at a freezing point of water, i.e. 0° C. or below while an ice making container is filled with ice-making water. The ice-making water in the ice making container starts to freeze from a part that first comes into contact with an ambient chill, and gradually freezes toward the center. That is, the ice-making water in the ice making container starts to freeze from a water surface that first comes into contact with the ambient chill or from a part being in contact with the inner surface of the ice making container and thus forms an ice nucleus from which formation of an ice crystal is triggered and propagates toward the center of the ice making container filled with the ice-making water, thereby entirely becoming ice.

The ice-making water supplied to the ice making container contains a certain amount of air in the form of bubbles. To make clear ice, such air bubbles have to be exhausted into the air. However, in a general ice making method, the ice-making water in the ice making container starts to freeze from the water surface as described above, so air bubbles are not exhausted into the air but remain in the water during ice making, and therefore cloudy ice is ultimately made.

To eliminate the air bubbles, which is disturbed in making ice transparent, there has been proposed a technique that repeats supplying a given amount of ice-making water a little at a time and then making ice. If the ice-making water is supplied a little at a time, air bubbles may be removed while the supplied ice-making water is frozen into ice in an ice making container. If the ice-making water is repeatedly supplied onto the made ice a little at a time, the ice-making water may be frozen into ice with removing the air bubbles. As a result, since the ice is not made from the water surface, but from a bottom side of the ice making container, air bubbles may be removed different from the general ice making method.

Further, in a conventional technique that makes transparent ice by using a thawing rod, an energy is consumed by the thawing rod, which radiates heat. Also, a heating device used when the thawing rod is immersed in and taken out of the ice-making water, a space occupied by the heating device, a separating device and a space occupied by the separating device have to be all taken into account when designed. Therefore, a problem arises in that an ice maker causes a loss of power, has a complicated structure and becomes bulky, thereby reducing a capacity for storage things capable of being accommodated in the refrigerator.

SUMMARY

An aspect of the disclosure is to provide an ice maker, which may selectively make ice having a transparency a user wants, reduce an energy used in making the ice, provide ice having an enhanced transparency, and make the ice and separate the ice with simplified structure, and a control method thereof.

According to an embodiment of the disclosure, there is provided an ice maker of a refrigerator including: a water supply configured to supply an ice-making water; an ice making container configured to be filled with the supplied ice-making water; a cooler configured to provide a chill to the ice-making water filled in the ice making container to cool the ice-making water; a water supplying-ice separator configured to include a water supplying shaft having therein a water passage through which the ice-making water supplied from the water supply enters, and a plurality of outlets through which the entered ice-making water is discharged to the ice making container, and at least one ice separating rod provided on the water supplying shaft; a driver configured to rotate the water supplying-ice separator; and a controller configured to control the driver, so that the at least one ice separating rod separates the made ice from the ice making container by the rotation of the water supplying-ice separator. According to this, the ice maker can not only be smaller in bulk, but also be simplified in structure.

The controller may be configured to control the driver to repeat a discharging state where a rotation angle of the plurality of outlets by the rotation of the water supplying-ice separator is less than a given angle from a center of the ice making container to discharge the ice-making water and a discharge-restricting state where the rotation angle of the plurality of outlets by the rotation of the water supplying-ice separator is equal to or more than the given angle from the center of the ice making container to prevent the ice-making water from being discharged. Accordingly, the ice maker may make a general ice and a transparent ice having a high transparency.

The controller may be configured to carry out one of a first mode for making ice having a first transparency or a second mode for making ice having a second transparency higher than the first transparency, and to carry out the second mode by repeating the discharging state and the discharge-restricting state through the rotation of the water supplying-ice separator.

The controller may be configured to control the driver to drive the water supplying-ice separator in the discharging state and the discharge-restricting state according to a water level of the ice-making water in the water passage.

The controller may be configured to control the driver to change a falling position of the discharged ice-making water by changing a position of the plurality of outlets. Accordingly, the ice maker may change a shape of ice being made.

The water supplying shaft may include an inlet provided at one side of a cylinder, and the water passage may be formed to extend to the other side of the cylinder along an axial direction thereof from the inlet.

The ice making container may include a plurality of cells arranged in a given direction, the water supplying shaft may be configured to be formed in a cylindrical form extended along the arranged direction of the plurality of cells at an upper side of the ice making container, and the plurality of outlets may be configured to be provided in positions corresponding to the plurality of cells, so that the entered ice-making water is discharge to the plurality of cells, respectively. Accordingly, the ice maker may make a plurality of ices when making the ice one time.

The at least one ice separating rod may include a plurality of ice separating rods formed by a number corresponding to the plurality of cells, to project from an outer circumference surface of a cylinder of the water supplying shaft in positions corresponding to the plurality of cells, respectively.

Among the plurality of outlets, outlets located at an upstream side of the water passage may be configured to be smaller in size than outlets located at the remaining side of the water passage.

Outlets located at end sides of the water passage may be configured to be smaller in size than outlets located at a center side of the water passage.

A water supplying cover may be configured to be provided on the outlets to determine whether the ice-making water is discharged.

The ice maker may further include a heater configured to supply heat to the water supplying cover. Accordingly, the ice maker may remove ice located on the water supplying cover, thereby preventing malfunction of the ice maker.

The ice maker may further include a heater configured to supply heat to the ice making container. Accordingly, the ice maker may easily separate the made ice from the ice making container.

The ice maker may further include a space configured to be filled with the ice-making water entered into the water passage. Accordingly, the ice-making water may be easily discharged from the water passage.

According to another embodiment of the disclosure, there is provided a control method of an ice maker in a refrigerator including: supplying an ice-making water from a water supply; filling an ice making container with the supplied ice-making water; providing a chill to the ice-making water filled in the ice making container to cool the ice-making water; rotating a water supplying-ice separator by a driver, the water supplying-ice separator including a water supplying shaft having therein a water passage through which the ice-making water supplied from the water supply enters, and a plurality of outlets through which the entered ice-making water is discharged to the ice making container, and at least one ice separating rod provided on the water supplying shaft; and controlling the driver, so that the at least one ice separating rod separates the made ice from the ice making container by the rotation of the water supplying-ice separator. According to this, the ice maker can not only be smaller in bulk, but also be simplified in structure.

The rotating may further include controlling the driver to repeat a discharging state where a rotation angle of the plurality of outlets by the rotation of the water supplying-ice separator is less than a given angle from a center of the ice making container to discharge the ice-making water and a discharge-restricting state where the rotation angle of the plurality of outlets by the rotation of the water supplying-ice separator is equal to or more than the given angle from the center of the ice making container to prevent the ice-making water from being discharged. Accordingly, the ice maker may make a general ice and a transparent ice having high transparency.

The control method may further include carrying out one of a first mode for making ice having a first transparency or a second mode for making ice having a second transparency higher than the first transparency, and carrying out the second mode by repeating the discharging state and the discharge-restricting state through the rotation of the water supplying-ice separator.

The controlling the driver may further include controlling the driver to drive the water supplying-ice separator in the discharging state and the discharge-restricting state according to a water level of the ice-making water in the water passage.

The controlling the driver may further include controlling the driver to change a falling position of the discharged ice-making water by changing a position of the plurality of outlets. Accordingly, the ice maker may change a shape of ice being made.

The control method may further include supplying, by a heater, heat to a water supplying cover provided on the outlets to determine whether the ice-making water is discharged. Accordingly, the ice maker may remove ice located on the water supplying cover, thereby preventing malfunction of the ice maker.

The control method may further include supplying, by a heater, heat to the ice making container. Accordingly, the ice maker may easily separate the made ice from the ice making container.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION

Figure 1:
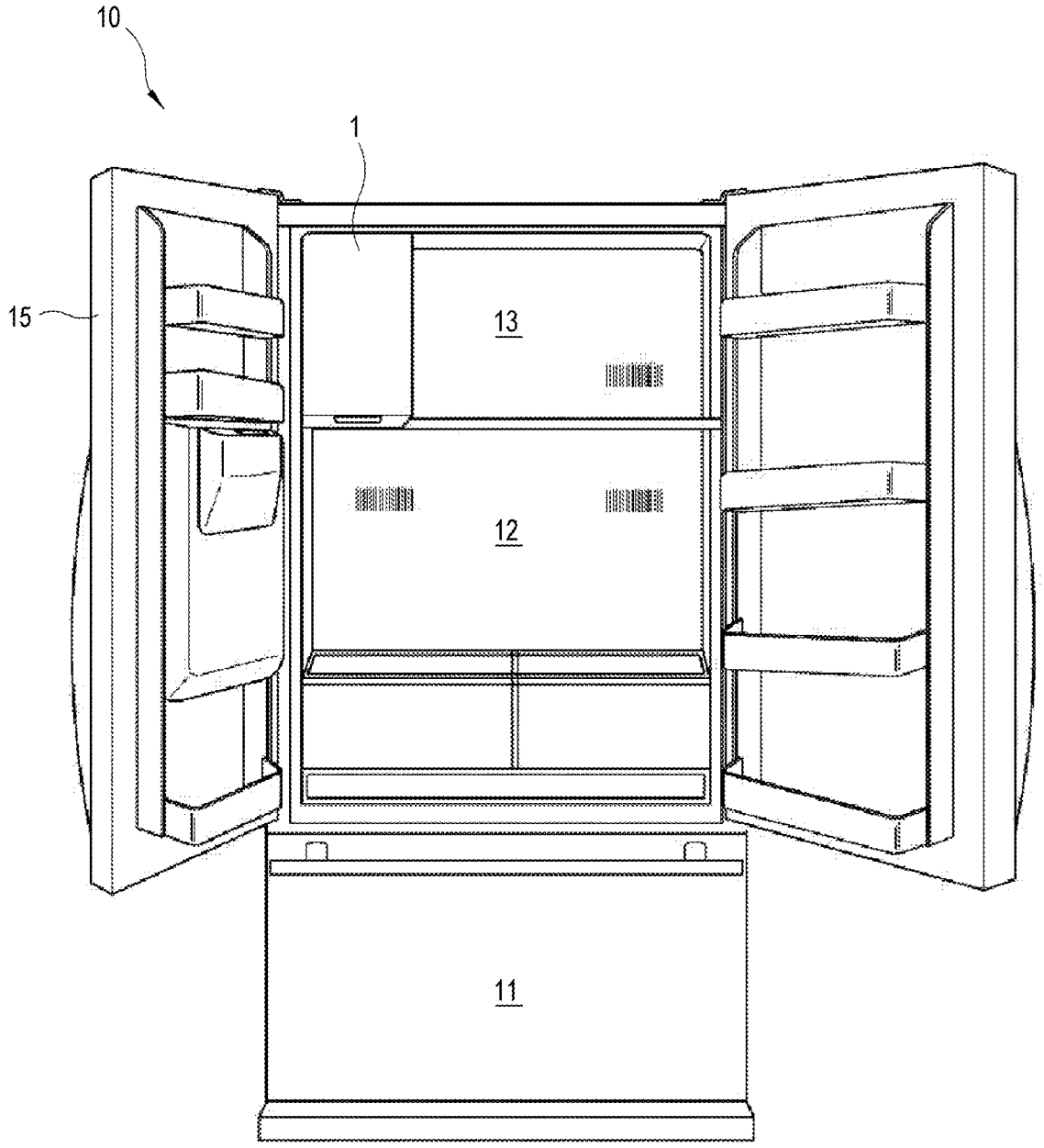
FIGS. 1 and 2 illustrate a font view and a section view showing a front and a lateral section of a refrigerator according to an embodiment of the disclosure, of which doors are open, respectively.

FIGS. 1 through 22, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Below, embodiments will be described in detail with reference to accompanying drawings. In the accompanying drawings, like reference numerals or symbols denote like elements, which substantially perform the same functions and the size of each element may be exaggerated for clarity and convenience of explanations. However, the technical sprit and core constructions and effects of the disclosure are not limited to those of the embodiments described herein. To clearly describe the disclosure, descriptions of well-known technologies or constructions, which can cloud the gist of the disclosure, will be omitted.

In various embodiments described herein, terms, each of which includes such an ordinal number as 'first', 'second' and the like, are only used for the purpose of discriminating one element from other elements, and terms, each of which is in the singular, are used to include the plural unless the context expressly otherwise requires. Further, in the embodiments, if terms, such as 'comprise', 'include', 'have' and the like, are used, it should be understood that those terms do not exclude the possibility that more than one other feature, number, step, operation, element, part or a combination thereof exists or is added. Also, in the embodiments, "module" or "unit" may carry out at least one function or operation, may be realized as a software, a hardware or a combination thereof, and may be realized as at least one processor, which is integrated into at least one module.

In the embodiments, if terms, such as "at least one of a plurality of elements" or the like, are used, it should be understood that those terms refer to each element or a combination thereof, which excludes the reminder of the plurality of elements, as well as all of the plurality of elements.

An ice maker 1 (in FIG. 1) according to an embodiment of the disclosure may include a refrigerator having a refrigerating compartment 12 (in FIG. 1) and a freezing compartment 11 (in FIG. 1) capable of freezing ice, a freezer having a freezing compartment dedicated to making ice, or an ice machine dedicated to making ice (hereinafter, also referred to 'a refrigerator'). Further, the ice maker 1 according to an embodiment of the disclosure may include am upright refrigerator or built-in premium freezer of an indirect or direct cooling type. Below, an overall structure for the refrigerator will be described with reference to FIGS. 1 and 2.

Figure 2:
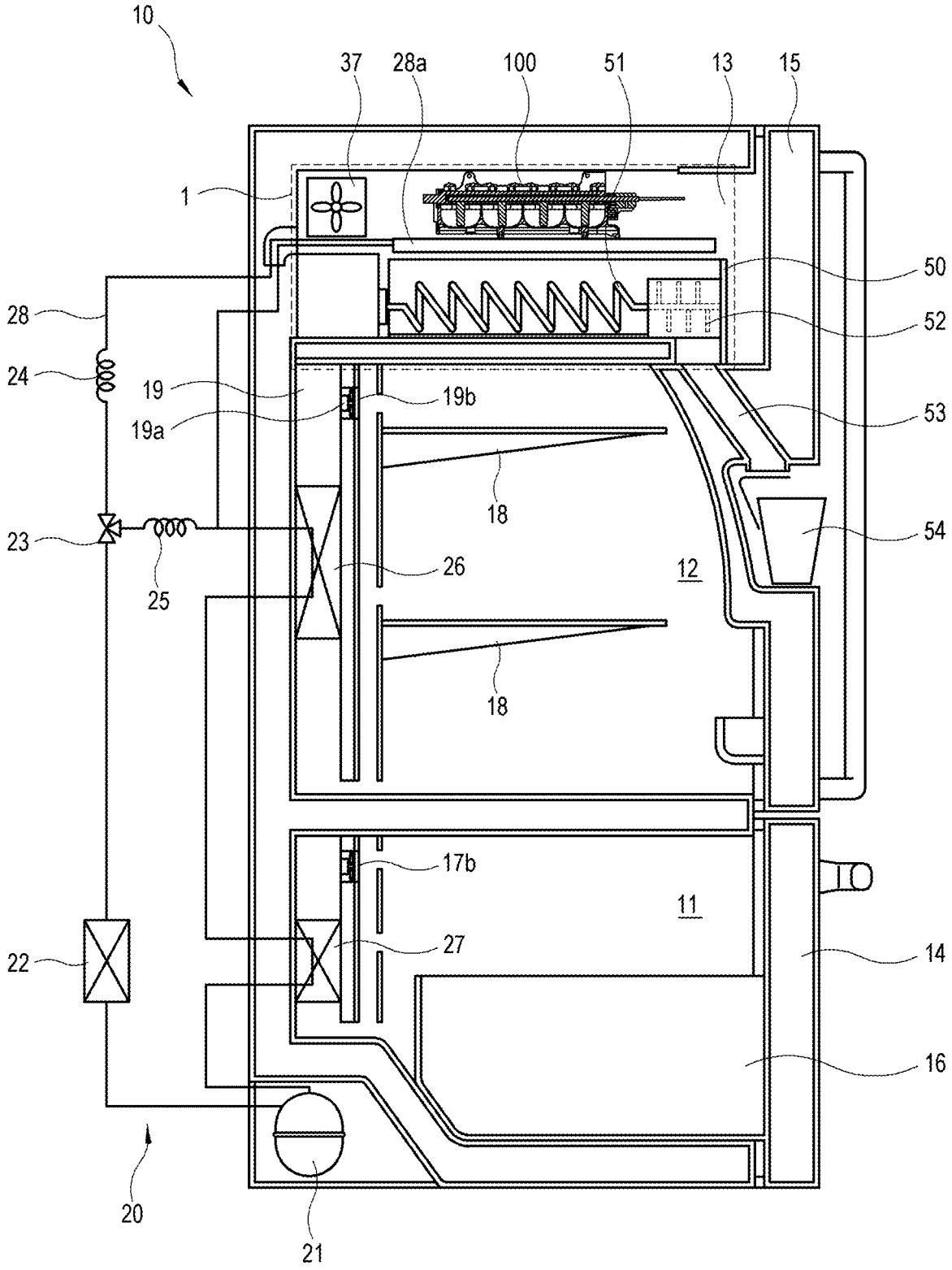

FIGS. 1 and 2 illustrate a front view and a section view showing a front and a lateral section of the refrigerator according to an embodiment of the disclosure, of which doors are open, respectively.

As shown in FIGS. 1 and 2, the refrigerator includes a main body 10 having a freezing compartment 11, a refrigerating compartment 12 and an ice-making compartment 13; a freezing compartment door 14 for opening and closing the freezing compartment 11; a refrigerating compartment door 15 for opening and closing the refrigerating compartment 12; and a cooler 20 (FIG. 2) for supplying a chill to the freezing compartment 11, the refrigerating compartment 12 and the ice-making compartment 13.

The freezing compartment 11 may be filled with a storage thing. The freezing compartment 11 may be provided with a freezing box 16, so that a user can put storage things in the freezing box 16, thereby keeping the storage things frozen.

The freezing compartment 11 may be provided with a first cool-air supply duct 17 in a rear wall thereof. In the first cool-air supply duct 17, there may be installed a freezing-compartment evaporator 27 of the cooler 20, a freezing fan 17*a*, and a freezing-compartment cool-air outlet 17*b*. The freezing fan 17*a* is capable of supplying a chill, which has been subjected to heat exchange by the freezing-compartment evaporator 27, to the freezing compartment 11 via the freezing-compartment cool-air outlet 17*b*.

The refrigerating compartment 12 may be filled with a storage thing. The refrigerating compartment 12 may be provided with a plurality of racks 18, so that a user can put storage things on each rack 18, thereby keeping the storage things refrigerated.

The refrigerating compartment 12 may be provided with a second cool-air supply duct 19 in a rear wall thereof. In the second cool-air supply duct 19, there may be installed a refrigerating-compartment evaporator 26 of the cooler 20, a refrigerating fan 19*a*, and a refrigerating-compartment cool-air outlet 19*b*. The refrigerating fan 19*a* is capable of supplying a chill, which has been subjected to heat exchange by the refrigerating-compartment evaporator 26, to the refrigerating compartment 12 via the refrigerating-compartment cool-air outlet 19*b*.

The ice-making compartment 13 is partitioned from the refrigerating compartment 12 by an ice-making compartment casing that forms a predetermined space therein, and thus formed as insulated from the refrigerating compartment 12.

The ice-making compartment 13 may be provided with an ice making unit 100 for making ice, and an ice storage container 50 for storing the ice made by the ice making unit 100. The ice made by the ice making unit 100 may be stored in the ice storage container 50, and the ice stored in the ice storage container 50 may be transferred to an ice crusher 52 by a transferrer 51. The ice crushed by the ice crusher 52 may be supplied to a dispenser 54 via an ice discharging duct 53.

The ice making unit 100 may be installed with at least a part of a coolant pipe 28 of the cooler 20. A direct cooler 28*a* of the coolant pipe 28 in the cooler 20 may exchange heat with the ice making unit 100 and thus cool the ice making unit 100.

Further, the ice-making compartment 13 may be installed with an ice making fan 37 for circulating air therein. The ice making fan 37 may forcibly make air in the ice-making compartment 13 flow toward the direct cooler 28*a* of the coolant pipe 28 or the ice making unit 100, so that the air in the ice-making compartment 13 can be cooled by exchanging heat with the direct cooler 28*a* of the coolant pipe 28 or the ice making unit 100.

The cooler 20 may include a compressor 21, a condenser 22, a switching valve 23, a first expansion valve 24, a second expansion valve 25, the refrigerating-compartment evaporator 26, the freezing-compartment evaporator 27, and the coolant pipe 28.

The coolant pipe 28 may connect the compressor 21, the condenser 22, the first expansion valve 24, the second expansion valve 25, the refrigerating-compartment evaporator 26, and the freezing-compartment evaporator 27. Coolant flowing in the coolant pipe 28 may be compressed by and discharged from the compressor 21, may be condensed by the condenser 22, may undergo an expansion process through the second expansion valve 25, and may be then supplied to the refrigerating-compartment evaporator 26 and the freezing-compartment evaporator 27. The coolant supplied to the refrigerating-compartment evaporator 26 may be evaporated by the refrigerating-compartment evaporator 26 to exchange heat with air in the refrigerating compartment 12 and cool the air in the refrigerating compartment 12, and may be then supplied to the freezing-compartment evaporator 27. The coolant supplied to the freezing-compartment evaporator 27 may exchange heat with air in the freezing compartment 11 and cool the air in the freezing compartment 11. Further, the coolant flowing in the coolant pipe 28 may be expanded by the first expansion valve 24, may pass through the direct cooler 28*a* of the ice-making compartment 13, and may be supplied to the refrigerating-compartment evaporator 26 and the freezing-compartment evaporator 27 in sequence.

In FIG. 2, the direct cooling type that the coolant directly passes through the direct cooler 28*a* of the coolant pipe 28 is explained as an example, but the indirect cooling type where coolant passes through the ice-making compartment evaporator may be also applied.

In the drawings of the disclosure, X, Y and Z may represent three directions of vertical to one another in a space. Directions opposite to X, Y and Z are represented by −X, −Y and −Z, respectively. In the embodiments described below, for convenience, a direction provided on an opened side among sides of the ice making unit 100 viewed from a center of the ice making unit 100 may be represented by the direction of X, and a direction where a driver 4040 (FIG. 4) is provided from the center of the ice making unit 100 may be represented by the direction of −X. A direction of an non-opened side among the sides of the ice making unit 100 viewed from the center of the ice making unit 100 may be represented by the direction of Y, and a direction opposite to the non-opened side among the sides of the ice making unit 100 viewed from the center of the ice making unit 100 may be represented by the direction of −Y. A direction where a bottom surface of the ice making unit 100 is provided from the center of the ice making unit 100 may be represented by the direction of −Z, and a direction where an upper surface opposite to the bottom surface of the ice making unit 100 is located from the center of the ice making unit 100 may be represented by the direction of Z. Also, among axes of the three directions, an axis comes to a perpendicular direction with respect to a plane to which the remaining two axes are parallel, For example, a direction of X comes to a perpendicular direction with respect to a plane of Y-Z. Below, a structure of the ice making unit 100 will be described.

Figure 3:
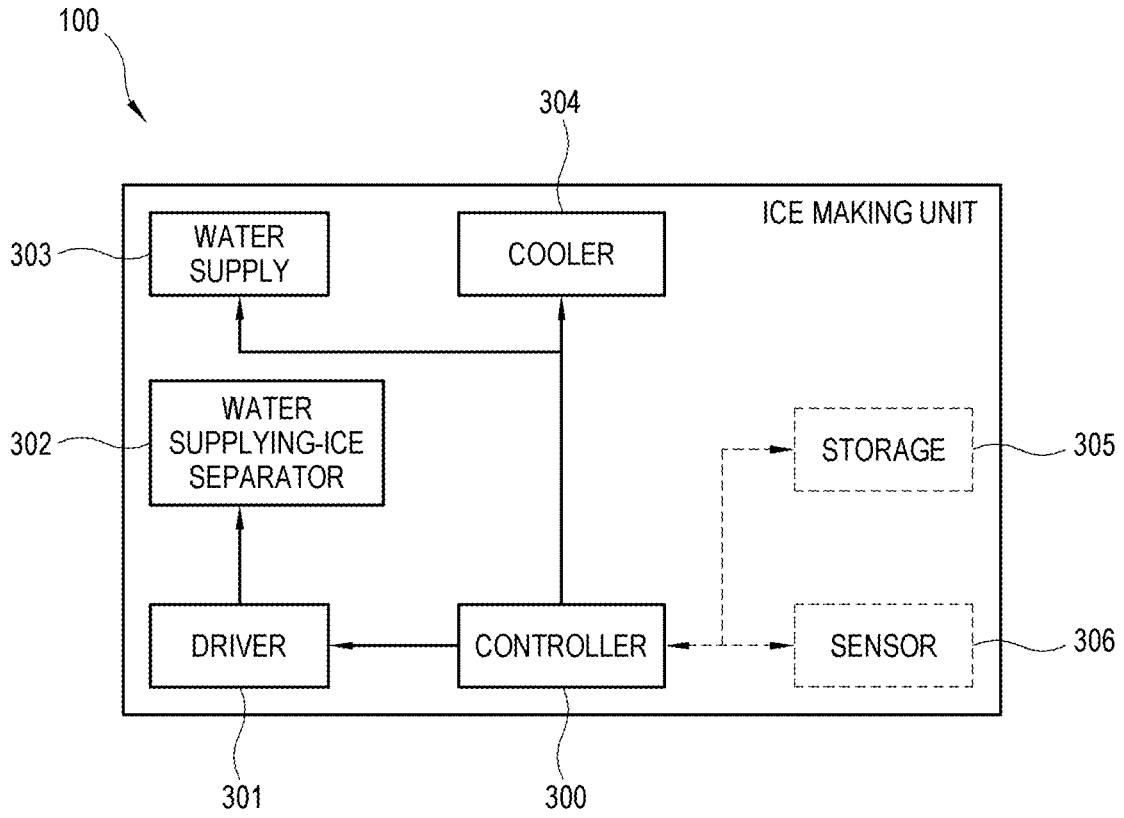
FIG. 3 illustrates a block diagram showing a structure of an ice making unit according to an embodiment of the disclosure.

FIG. 3 illustrates a block diagram showing a structure of the ice making unit 100 according to an embodiment of the disclosure. As shown in FIG. 3, the ice making unit 100 may include a controller 300, a driver 301, a water supplying-ice separator 302, a water supply 303, a cooler 304, a storage 305 and a sensor 306.

The driver 301 may drive to rotate the water supplying-ice separator 302 according to a control of the controller 300. The driver 301 may include a driving device, such as a motor or the like. The motor may be supplied with electricity to perform rotation movement and thus rotate the water supplying-ice separator 302 connected to the motor (see 4050 in FIG. 5). The controller 300 may adjust a rotation degree of the motor of the driver 301 and thus a rotation degree (hereinafter, also referred to a 'rotation angle') of the water supplying-ice separator 302.

The water supply 303 may supply an ice-making water to a water supplying cup 4021 (FIG. 4) according to a control of the controller 300. The controller 300 may adjust an amount of the ice-making water supplied to the water supplying cup 4021. The controller 300 may adjust a rotation degree of the water supplying-ice separator 302 to adjust an amount of the ice-making water, which is required to supply to an ice making container 4010.

The cooler 304 may cool the ice making container 4010 (FIGS. 4 and 5) or its surroundings to lower their temperature according to a control of the controller 300. The controller 300 may control the cooler 304 to adjust the temperature of the ice making container 4010 or its surroundings, thereby maintaining the ice making container 4010 or its surroundings in a temperature a user wants.

The storage 305 may store various pieces of information about the ice making unit 100. For example, the storage 305 may store information related to a cooling temperature, an ice making mode, an ice size, etc., which are set by the user.

The sensor 306 may include various sensors necessary to operate the ice making unit 100. For example, the sensor 306 may include a temperature sensor for measuring a temperature, and a sensor for measuring positions or rotation degrees of elements of the ice making unit 100. These sensors are not limited thereto and may further include other sensors.

The controller 300 generally controls the elements of the ice making unit 100 to generate ice according to the cooling temperature, the ice making mode, etc., which are set by the user.

The controller 300 may for example be actualized by an integrated circuit having a control function like a system on chip (SoC), or a control circuit substrate including a software and a universal processor, such as a central processing unit (CPU), a micro processing unit (MPU), etc.

The universal processor may include a nonvolatile memory in which a control program (or an instruction) for performing control operations is installed, a volatile memory in which at least a portion of the installed control program is loaded, and at least one processor or CPU in which the loaded control program is executed.

Figure 4:
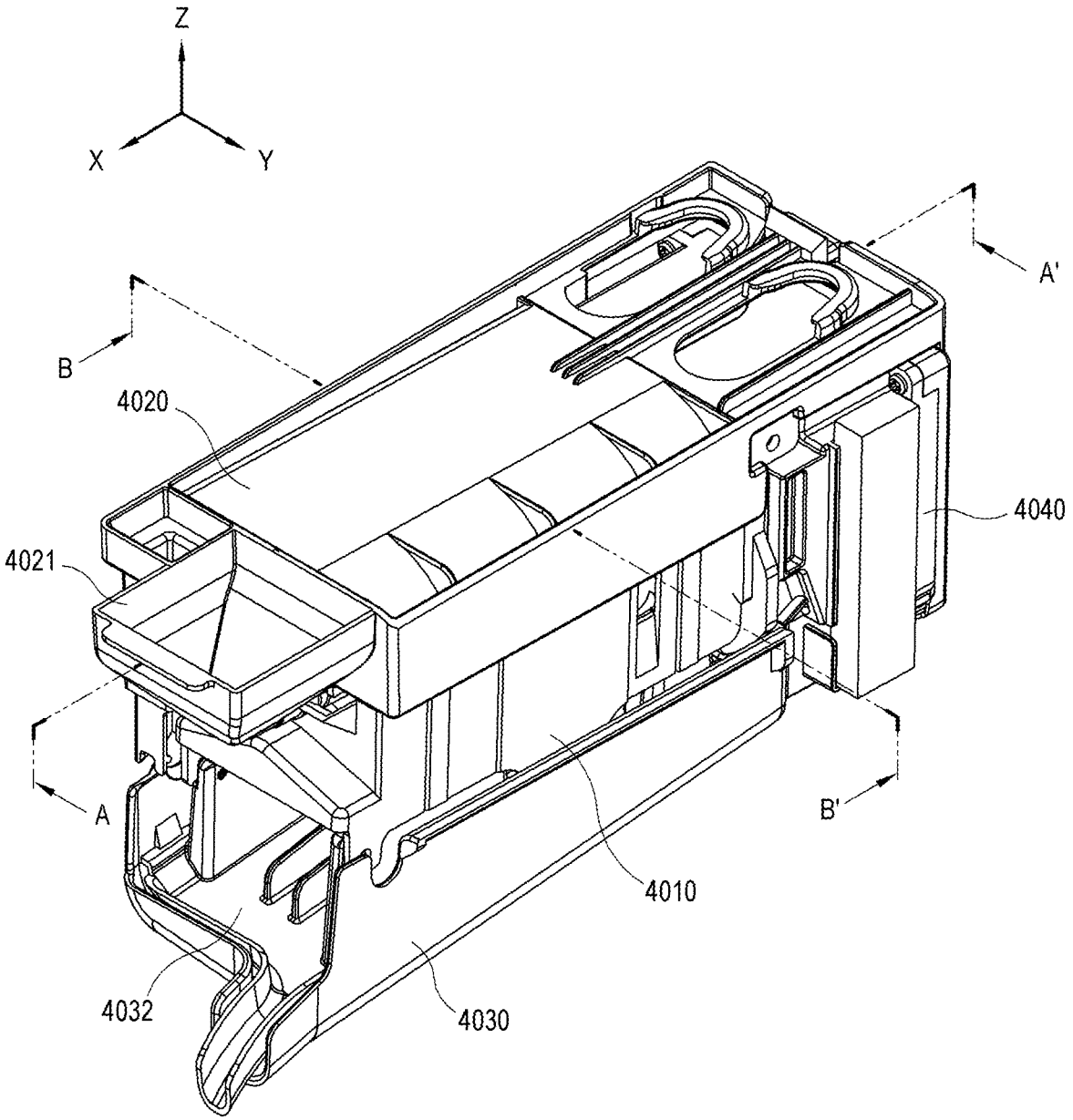
FIGS. 4 and 5 illustrate a perspective view and an exploded perspective view of an ice making unit according to an embodiment of the disclosure, respectively.
Figure 5:
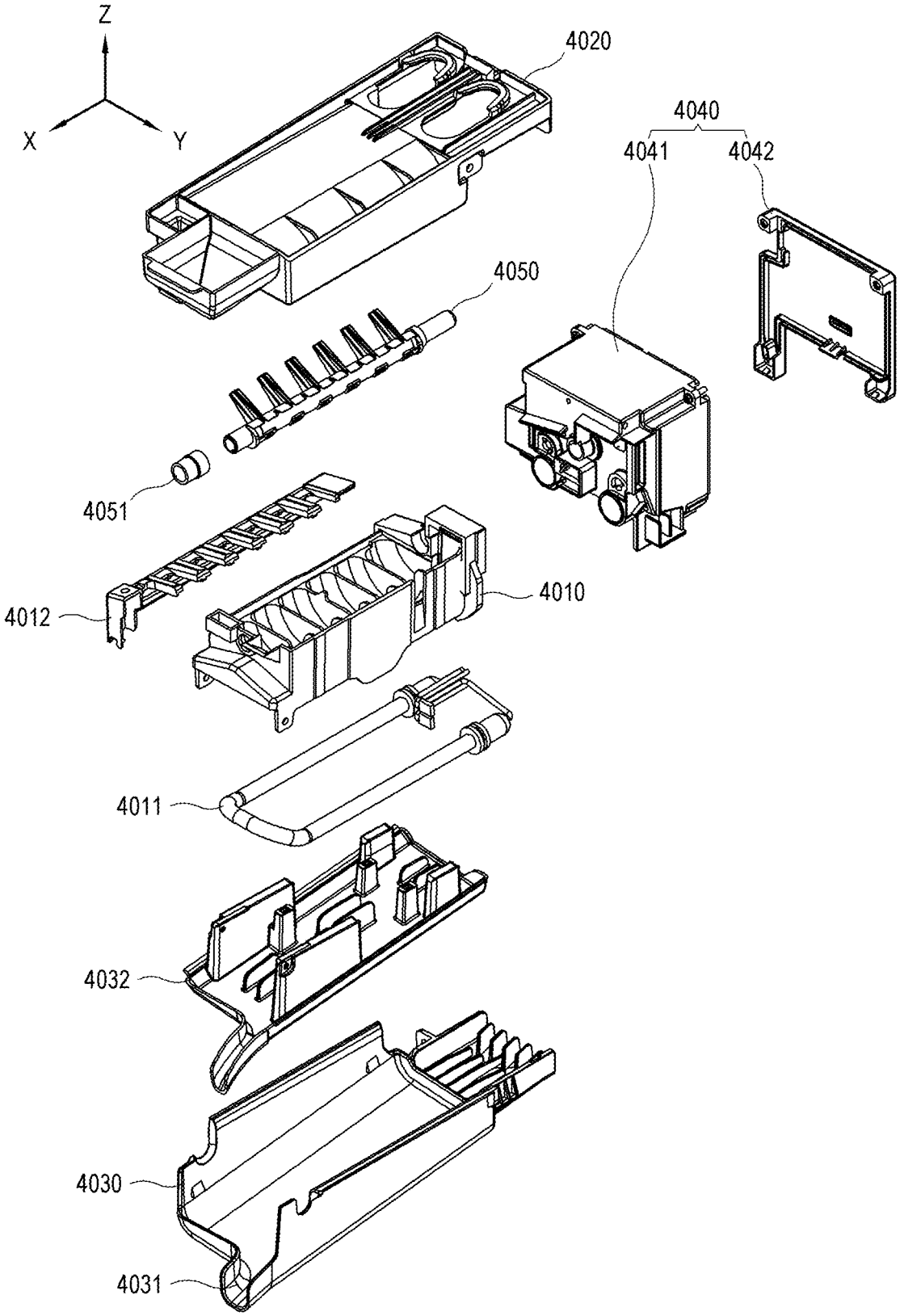

FIGS. 4 and 5 illustrate a perspective view and an exploded perspective view of the ice making unit 100 according to an embodiment of the disclosure, respectively. As shown in FIGS. 4 and 5, the ice making unit 100 includes the ice making container 4010, a cover 4020, a lower casing 4030, a driver 4040, a water supplying-ice separator 4050, a cooling pipe 4011, a side cover 4012, and a connection cork 4051.

In the ice making container 4010 is provided a plurality of spaces 4013 (FIG. 6) (hereinafter, also referred to 'cells'), which is be filled with the supplied ice-making water. The ice making container 4010 may directly or indirectly exchange heat with the cooling pipe 4011 to make ice by freezing the ice-making water filled in the plurality of cells 4013. Since the plurality of cells 4013 are provided, they may make a plurality of ices when making the ices once.

As an additional embodiment, a heater may be provided in the ice making container 4010. The heater provided in the ice making container 4010 may melt the made ice. When a portion of the made ice, which contact with the heater, are changed into an ice-making water, the made ice may be apt to be separated from the ice making container 4010. For example, the heater may be provided in the form of a film or membrane in the ice making container 4010. The heater may be provided in various shapes, and kinds thereof are not limited.

The cover 4020 may be provided on an upper side of the ice making container 4010 to combine with the ice making container 4010, thereby preventing foreign substances from entering into the ice making container 4010. The cover 4020 may be provided with the water supplying cup 4021. The water supplying cup 4021 may be located on a path through which the ice-making water entered into the ice making unit 100 passes.

The lower casing 4030 may be provided on a lower side of the ice making container 4010 to combine with the ice making container 4010. The lower casing 4030 includes an ice container 4032 in which the ice separated from the ice making container 4010 is accommodated. Also, the lower casing 4030 includes an ice outlet 4031 for discharging the ice accommodated in the ice container 4032 out of the ice making unit 100. The lower casing 4030 may have a shape configured so that the ice separated from the cells 4013 can be smoothly moved out of the ice making unit 100. For example, the lower casing 4030 may be slopingly formed, so that the ice separated from the cells 4013 can be moved in a direction of X axis. To be more specific, the lower casing 4030 may be provided, so that a first portion of the lower casing 4030 remote from the ice outlet 4031 is higher than a second portion of the lower casing 4030 close to the ice outlet 4031.

The driver 4040 may be provided in a direction of −x axis of the ice making container 4010 on a lower side of the cover 4020 to combine with the cover 4020 and the ice making container 4010. The driver 4040 may rotate the water supplying-ice separator 4050. The cooling pipe 4011 may be connected with the coolant pipe 28, and provided in a shape of the direct cooler 28*a* shown in FIG. 2. The cooling pipe 4011 may be located at a lower portion of the ice making container 4010 to contact with and exchange heat with the ice making container 4010. The ice making container 4010 may be maintained in a low temperature to make ice from the ice-making water through the heat exchange with the cooling pipe 4011. Or, the cooling pipe 4011 may be provided, so that it does not contact with the ice making container 4010, but exchanges heat with air in the ice making container 4010 to cool the air therein, thereby making ice from the ice-making water filled in the ice making container 4010.

The water supplying-ice separator 4050 is provided between the ice making container 4010 and the cover 4020. The water supplying-ice separator 4050 according to an embodiment has two functions, i.e., a function supplying the ice-making water and a function separating the made ices. To be more specific, the water supplying-ice separator 4050 supplies the ice-making water fed from the water supply 303, to the cells 4013 of the ice making container 4010. Also, the water supplying-ice separator 4050 may be connected with the driver 4040 to rotate by the driver 4040. The ice made in the ice making container 4010 may be separated from the ice making container 4010 by the rotation of the water supplying-ice separator 4050. The ice separated from ice making container 4010 may be moved to the lower casing 4030.

The connecting cork 4051 is provided to connect the water supplying cup 4021 and the water supplying-ice separator 4050, thereby supplying the ice-making water fed from the water supplying cup 4021, to the water supplying-ice separator 4050.

The side cover 4012 is provided corresponding to a position of at least one ice separating rod 4052 (FIG. 6) of the water supplying-ice separator 4050, so that the at least one ice separating rod 4052 can pass by the side cover 4012 according to the rotation of the water supplying-ice separator 4050. The side cover 4012 is provided, so that the ice separated from the ice making container 4010 by the at least one ice separating rod 4052 are not returned to the ice making container 4010, but moved to the lower casing 4030. Below, the water supplying-ice separator 4050 according to an embodiment will be described in more detail.

Figure 6:
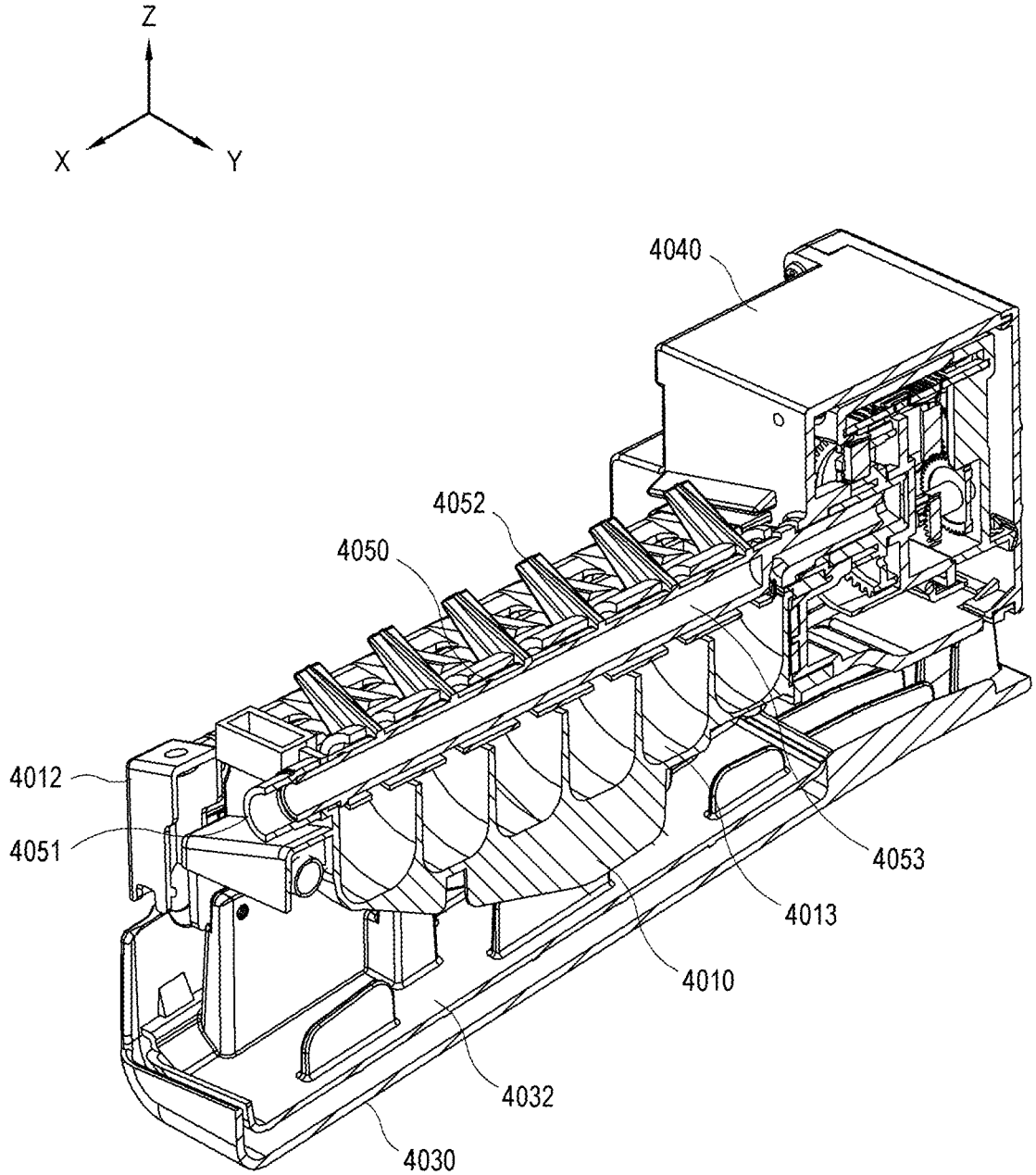
FIG. 6 illustrates a view of a water supplying-ice separator taken along a plane X-Z of FIG. 5, according to an embodiment of the disclosure.
Figure 7:
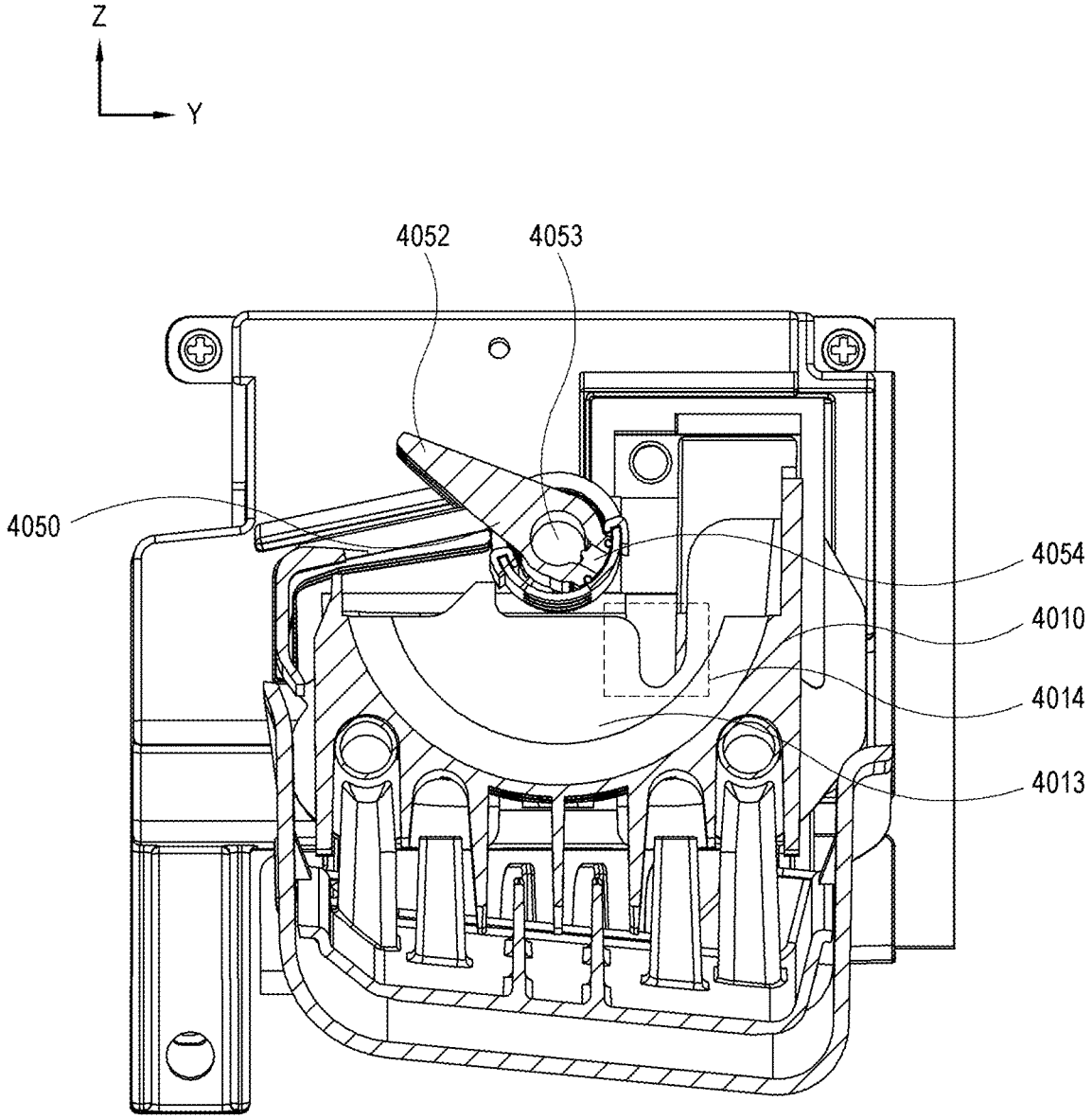
FIGS. 7 and 8 illustrate section views of an ice making unit taken along cross sections A-A' and B-B' of FIG. 4, respectively, according to an embodiment of the disclosure.
Figure 8:
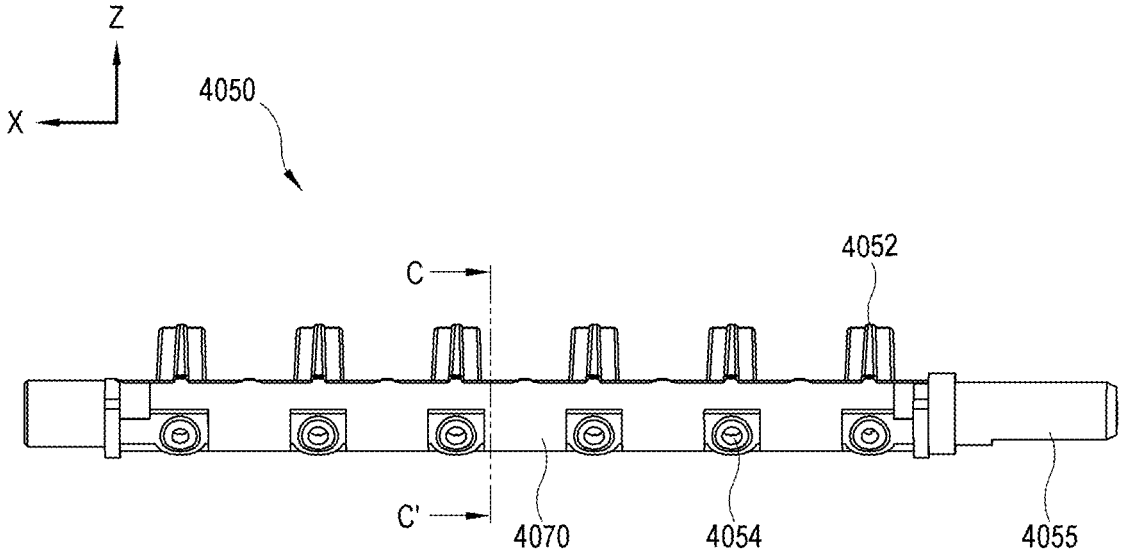

FIG. 6 illustrates a view of the water supplying-ice separator taken along a plane X-Z of FIG. 5, according to an embodiment of the disclosure. FIGS. 7 and 8 illustrates section views of the ice making unit 100 taken along cross sections A-A' and B-B' of FIG. 4, respectively, according to an embodiment of the disclosure. As shown in FIGS. 6 to 8, the water supplying-ice separator 4050 includes a water supplying shaft 4070 (FIG. 8). The water supplying shaft 4070 is provided in a cylindrical shape, which is extended in an axial direction. In the water supplying shaft 4070 is provided a water passage 4053 (FIG. 7). The ice-making water supplied through the connecting cork 4051 from the water supplying cup 4021 enters into the water passage 4053 and is filled in the water supplying shaft 4070. The water supplying-ice separator 4050 may be slopingly provided, so that the ice-making water can smoothly move from upstream to downstream in the water passage 4053. A upstream side of the water passage 4053 may be provided higher than a downstream side of the water passage 4053, so that the ice-making water can smoothly move from upstream to downstream due to gravity in the water passage 4053. The sloped water supplying-ice separator 4050 is merely an example and the present disclosure is not limited thereto.

An end 4055 of the water supplying shaft 4070 is connected with the driver 4040, so that the driver 4040 transmits power thereto. According to this, the water supplying shaft 4070 may rotate by the power transmitted from the driver 4040. A cross section of the end 4055 of the water supplying shaft 4070 may be provided in a nearly semicircle shape in consideration of an inter-combinability between the water supplying shaft 4070 and the driver 4040, but is not limited thereto.

Also, in the water supplying shaft 4070 is formed a plurality of outlets 4054, which provides physical communication between the water passage 4053 and the outside of the water supplying shaft 4070. The plurality of outlets 4054 is provided corresponding to the plurality of cells 4013 of the ice making container 4010. The ice-making water accommodated in the water passage 4053 of the water supplying shaft 4070 may be supplied to the plurality of cells 4013 of the ice making container 4010 provided on the lower side of the water supplying-ice separator 4050 through the plurality of outlets 4054, respectively, according to the rotation of the water supplying shaft 4070. To be more specific, when the water supplying shaft 4070 rotates, a height of the outlets 4054 in the axis of Z changes, and thus a water level in the water passage 4053 comes to be higher or lower than the height of the outlets 4054. In other words, if according to the rotation of the water supplying shaft 4070, the water level in the water passage 4053 comes to be higher than the height of the outlets 4054, the ice-making water is discharged to the outside through the outlets 4054.

The water supplying-ice separator 4050 according to an embodiment further includes the at least one ice separating rod 4052. The at least one ice separating rod 4052 is provided to protrude from an outer surface of the water supplying shaft 4070, and includes a plurality of ice separating rods 4052 arranged along an axial direction of the water supplying shaft 4070. The plurality of ice separating rods 4052 may be provided corresponding to the position and the number of the plurality of cells 4013 and the plurality of outlets 4054. The cells 4013 of the ice making container 4010 may be provided in a semicircular shape to correspond to a rotational radius of the ice separating rods 4052. The ice making container 4010 may be divided into the plurality of cells 4013 by partitions. On the partitions of the cells 4013 may be respectively provided water channels 4014 having a height lower than the partitions to move the ice-making water from one cell to adjacent another cell. According to the movement of the ice-making water, the water level of the ice-making water filled in the cells 4013 may be kept instant.

The plurality of ice separating rod 4052 may separate ices made in the cells 4013 to move out of the ice making container 4010 by rotating the water supplying shaft 4070. The plurality of ice separating rods 4052 may be provided on a portion opposite to a portion of the water supplying shaft 4070 in which the plurality of outlets 4054 is formed, respectively. Accordingly, when to separate the made ices, the ice separating rods 4052 are located at a lower side of the water passage 4053, the outlets 4054 may be located at an upper side of the water passage 4053, so that the ice-making water in the water passage 4053 may not be supplied to the cells 4013.

As the water supplying-ice separator 4050 performs both the function discharging the ice-making water to the ice making container 4010 and the function separating the ices made in the cells 4013 of the ice making container 4010, the ice maker can not only be smaller in bulk, but also be simplified in structure.

Figure 9:
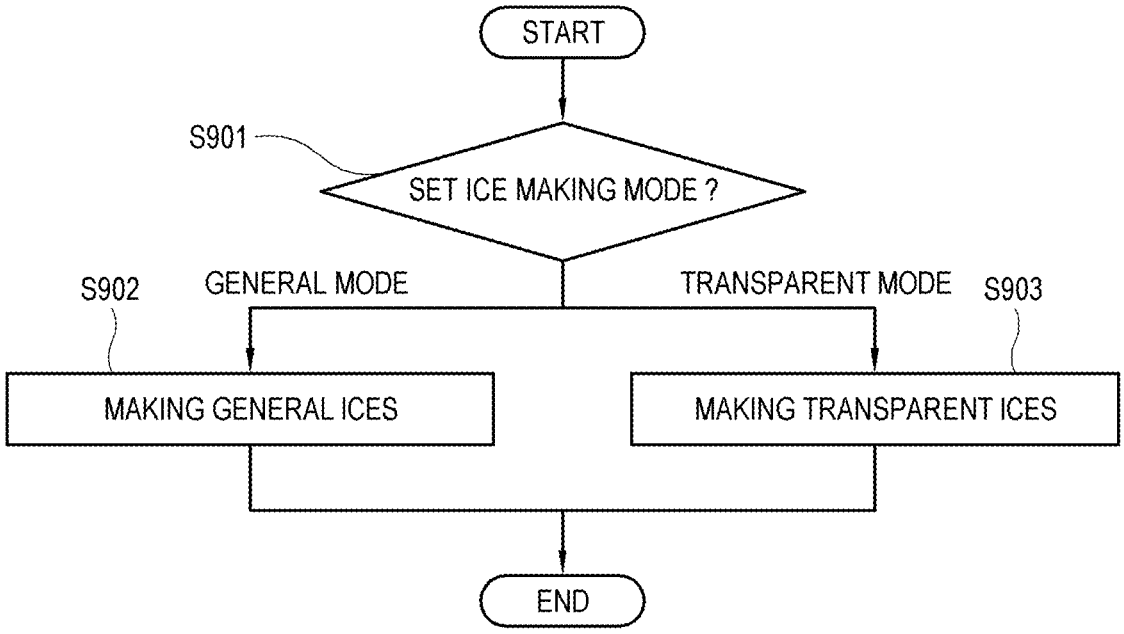
FIG. 9 illustrates a flowchart showing a process, which makes ices having different transparencies by an ice making unit according to an embodiment of the disclosure.

FIG. 9 illustrates a flowchart showing a process, which makes ices having different transparencies by the ice making unit according to an embodiment of the disclosure. The controller 300 according to an embodiment may carry out an ice making mode corresponding to a required transparency from among a plurality of ice making mode, thereby making ice having the required transparency.

To be more specific, the controller 300 may identify a set ice making mode (operation S901). The controller 300 may receive a user's input to set the ice making mode, and also set the ice making mode according to a scheduled operation. The ice making mode may be changed in the course of an ice making process.

When the set ice making mode is a general mode ('general mode' of S901), the controller 300 may operate in the general mode to make general ice (operation S902). The controller 300 may supply an ice-making water to the water supplying-ice separator 4050, which is in a discharging state, through the water supply 303. The supplied ice-making water may be directly discharged to the ice making container 4010 from the water supplying-ice separator 4050. The discharged ice-making water may cooled in the ice making container 4010 thereby to be made in the general ice.

Or, if the set ice making mode is a transparent mode ('transparent mode' of S901), the controller 300 may operate in the transparent mode to make transparent ice having transparency higher than the general ice (operation S903). A process making the transparent ice will be described in detail with reference to FIG. 10.

Below, a process making ice from the ice-making water by the ice making unit 100 according to an embodiment is explained.

Figure 10:
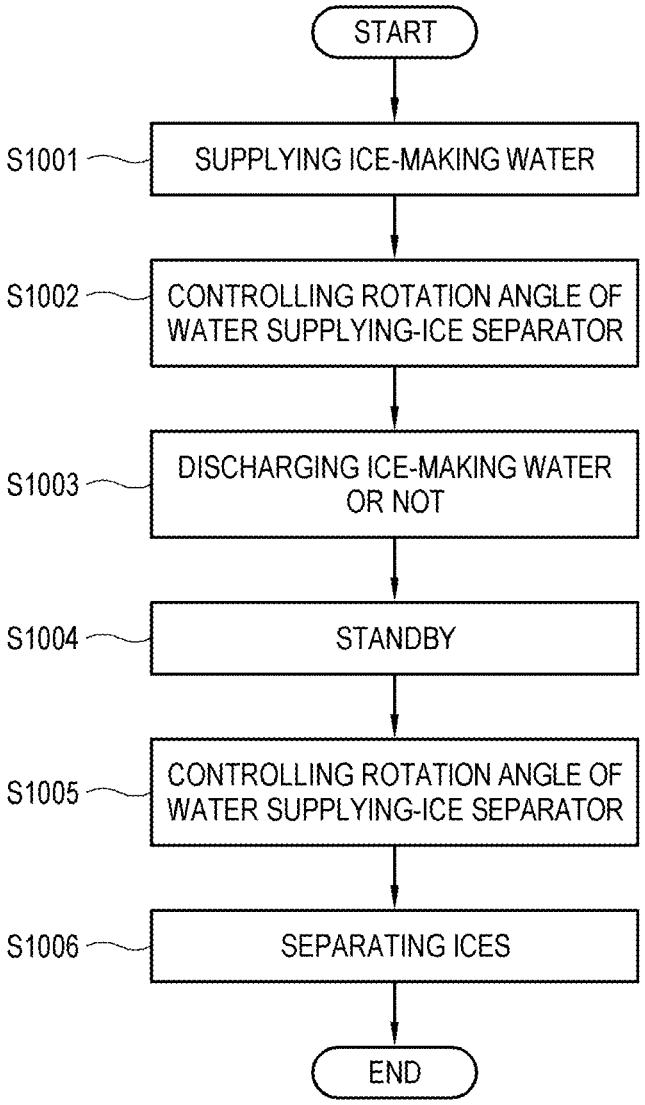
FIG. 10 illustrates a flowchart showing an ice making process, which is carried out by an ice making unit according to an embodiment of the disclosure.

FIG. 10 illustrates a flowchart showing the ice making process, which is carried out by the ice making unit according to an embodiment.

The water supply 303 supplies a given amount of ice-making water to the water supplying cup 4021 according a control of the controller 300 (operation S1001). The supplied ice-making water is moved to the water passage 4053 in the water supplying-ice separator 4050 via the connection cork 4051, which connects the water supplying cup 4021 and the water supplying-ice separator 4050. The water supply 303 may supply the ice-making water according a water level of the ice-making water in the water passage 4053 under a control of the controller 300.

The controller 300 may adjust a rotation degree of the water supplying-ice separator 4050 using the driver 301 (operation S1002). The rotation degree of the water supplying-ice separator 4050 may be fixed different according to an amount of the ice-making water supplied through the water supplying cup 4021 or an ice making mode set by a user.

According to the rotation degree of the water supplying-ice separator 4050, the ice-making water accommodated in the water passage 4053 is discharged to the ice making container 4010 via the outlet 4054 (operation S1003). An amount of the discharged ice-making water may be varied according to an amount of ice-making water supplied via the water supply 303, a rotation degree or a discharge maintaining time of the water supplying-ice separator 4050, etc.

The controller 300 may adjust the rotation degree of the water supplying-ice separator 4050 not to discharge the ice-making water accommodated in the water passage 4053 to the ice making container 4010 (operation S1003), or to stand by while maintaining as it is (operation S1004). According to the water level of the ice-making water in the water passage 4053, the controller 300 may control the water supplying-ice separator 4050 to change an operation thereof into a discharging state or a discharge restricting state.

The controller 300 may adjust the rotation degree of the water supplying-ice separator 4050, so that the ice separating rods 4052 separate ices made in the cells 4013 of the ice making container 4010 (operations S1005 and S1006). According to this, the ice making unit 100 may make ice.

If making transparent ice having transparency higher than the general ice, the controller 300 may repeat the operations S1001 to S1004 to make the transparent ice. According to embodiments, the controller 300 may reduce an amount of ice-making water discharged once to the cells 4013 of the ice making container 4010 and increase a discharging number of times of ice-making water discharged thereto. As the amount of ice-making water discharged once to the cells 4013 is reduced, a cooling time required in making ices from the ice-making water may be reduced. As the controller 300 controls to discharge the ice-making water plural times to the cells 4013, the ice-making water filled in the cells 4013 may be frozen to make ices toward an upper side from a lower side of the cells 4013. As the ices are made toward the upper side from the lower side of the cells 4013, air included in the ice-making water may be discharged out of the made ices. As the ices are made while the air included in the ice-making water is discharged, the made ices may have increased transparency.

Below, supplying or not the ice-making water according a rotation angle determined by the ice separating rods 4052 and the z axis is described.

Figure 11:
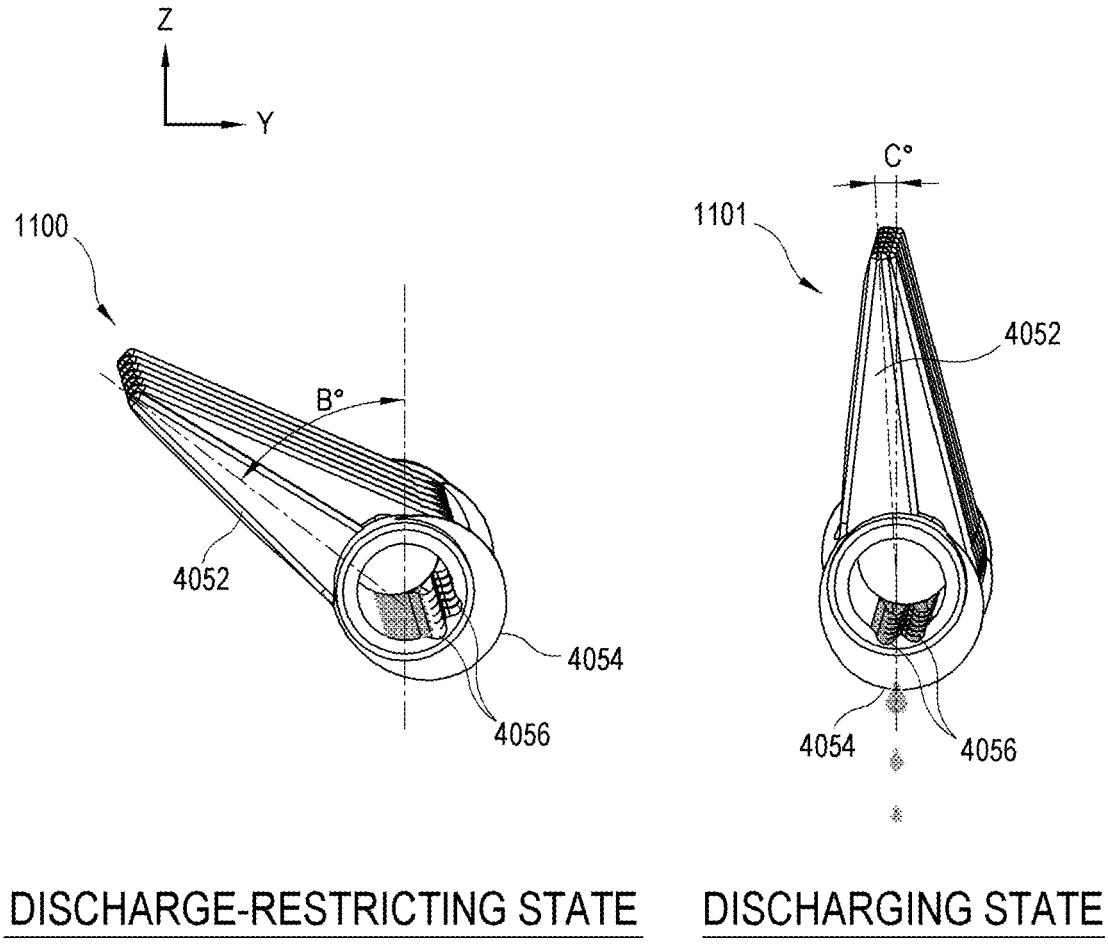
FIG. 11 illustrates a pair of first section views showing a portion of an ice making unit taken along cross sections B-B' of FIG. 4, respectively, and according to an embodiment of the disclosure.
Figure 12:
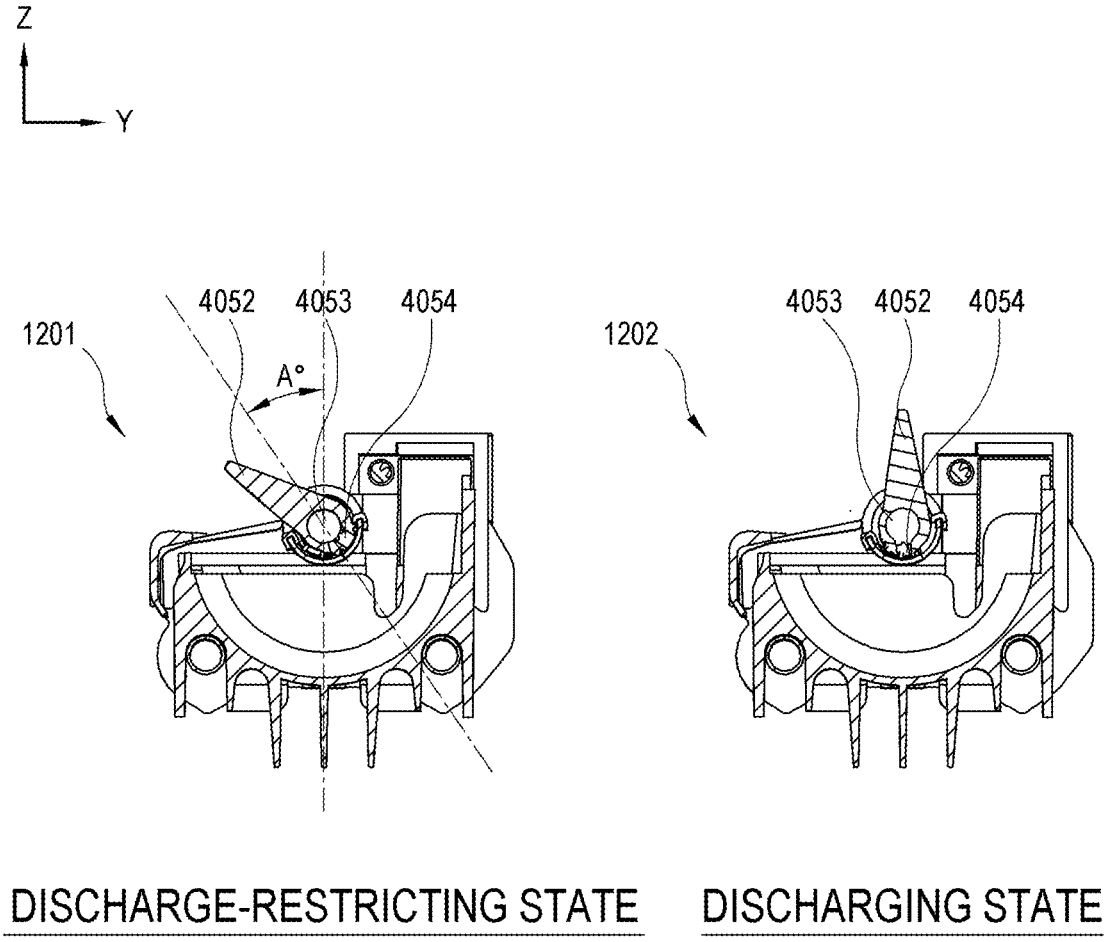
FIG. 12 illustrates a pair of second section views showing a water supplying-ice separator taken along cross sections C-C' of FIG. 8, respectively and according to an embodiment of the disclosure.

FIG. 11 illustrates a pair of first section views showing a portion of the ice making unit taken along cross sections B-B' of FIG. 4, respectively, and FIG. 12 illustrates a pair of second section views showing the water supplying-ice separator 4050 taken along cross sections C-C' of FIG. 8, respectively, in the same condition as the pair of first section views shown in FIG. 11, and according to embodiments of the disclosure.

In the water passage 4053 within the water supplying-ice separator 4050 may be provided channels 4056. The channels 4056 may be provided in a semicircle form on both sides of the outlets 4054 and with the outlets 4054 as the center in the water passage 4053 to be concaved toward the outside of the water supplying-ice separator 4050. Due to the channels 4056 provided around the outlets 4054, the ice-making water may be gathered in the vicinity of the outlets 4054, and thereby easily discharged out of the water supplying-ice separator 4050.

An angle determined by an axis parallel with the z axis passing the rotation shaft of the water supplying-ice separator 4050 and the ice separating rods 4052 located in a counterclockwise direction is referred as a 'rotation angle'. If the rotation angle is equal to or more than a certain angle, the water level of the ice-making water in the water passage 4053 may be lower than a height of the outlets 4054, so that the ice-making water cannot be discharged to the ice making container 4010 from the water supplying-ice separator 4050 (see water supplying-ice separator 1201). Below, a state where the ice-making water is not discharged is referred to a 'discharge-restricting state'. To the contrary, if the rotation angle is less than the certain angle, the water level of the ice-making water in the water passage 4053 may be higher than the height of the outlets 4054, so that the ice-making water can be discharged out of the water supplying-ice separator 4050 (see water supplying-ice separator 1202). Below, a state where the ice-making water is discharged is referred to a 'discharging state'.

Hereinafter, a minimum rotation angle in which the water supplying-ice separator 4050 may be maintained in the discharge-restricting state in a state where a given amount of ice-making water is accommodated in the water passage 4053 is referred to a 'discharge-restricting angle'. For example, if the ice-making water of 100 ml is accommodated in the water passage 4053, the discharge-restricting angle is assumed as A°. The discharge-restricting angle A° may be varied according to an amount of the ice-making water, which is accommodated in the water passage 4053. The amount of the ice-making water accommodated in the water passage 4053 may be varied according to an amount of the ice-making water, which is supplied from the water supply 303.

When the rotation angle of the water supplying-ice separator 4050 is B° larger than A°, which is the discharge-restricting angle, the ice-making water in the water passage 4053 is not discharged out of the water supplying-ice separator 4050 (see reference numeral 1100). When the rotation angle of the water supplying-ice separator 4050 is C° smaller than A°, which is the discharge-restricting angle, the ice-making water in the water passage 4053 may be discharged out of the water supplying-ice separator 4050 (see reference numeral 1101).

A value of A may be varied according to an amount of ice-making water accommodated in the water passage 4053. For example, if the ice-making water of more than 100 ml is accommodated in the water passage 4053, the discharge-restricting angle may be larger than the value of A. Or, if the ice-making water of less than 100 ml is accommodated in the water passage 4053, the discharge-restricting angle may be smaller than the value of A.

Figure 13:
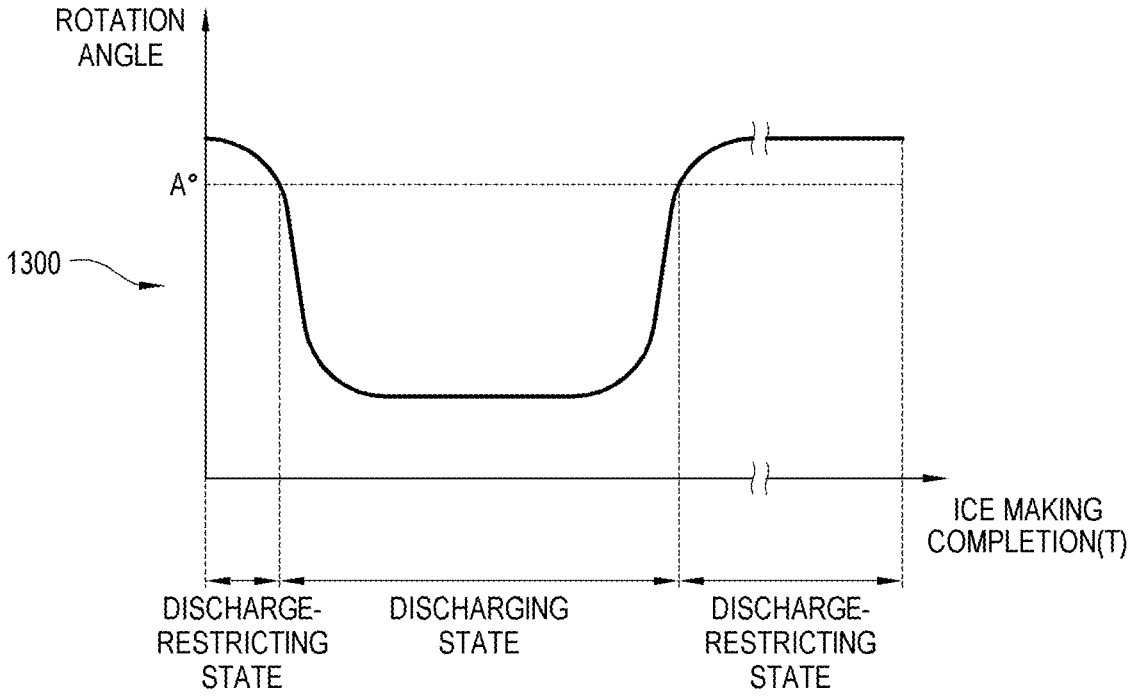
FIG. 13 illustrates a graph showing a time and an angle of outlets according to an embodiment of the disclosure.

FIG. 13 illustrates a graph showing a time and an angle of the outlets according to an embodiment of the disclosure. In the graph, a longitudinal axis shows a rotation angle and a horizontal axis shows a time. In the discharging state, as the ice-making water in the water passage 4053 is discharged, the discharge-restricting angle may be smaller than A°, but for convenience, the following explanations will be described ignoring changes in the discharge-restricting angle according to the discharged amount of the ice-making water.

If the rotation angle is larger than A°, the ice-making water may be not discharged to the ice making container 4010 from the inside of the water supplying-ice separator 4050. To the contrary, if the rotation angle is smaller than A°, the ice-making water may be discharged to the ice making container 4010 from the inside of the water supplying-ice separator 4050 (see water supplying-ice separator 1201).

An initial rotation angle of the water supplying-ice separator 4050 is assumed as being maintained in a state where it is equal or more than A°. When the rotation angle is equal or more than A°, the ice-making water may be not discharged from the inside of the water supplying-ice separator 4050. When the rotation angle is changed to be less than A°, the ice-making water may be discharged outside the water supplying-ice separator 4050. The discharged ice-making water may be cooled and turned into ice in the ice making container 4010.

As the water supplying-ice separator 4050 changes its rotation angle in the discharge-restricting state, it may be changed into the discharging state. After the ice-making water is discharged, the water supplying-ice separator 4050 may change its rotation angle in the discharging state, and thereby changed into the discharge-restricting state.

According to a time which maintains the water supplying-ice separator 4050 in the discharging state, the controller 300 may control to adjust an amount of the ice-making water which is discharged once to the ice making container 4010 from the water passage 4053. Explanations on this will be described together with reference to FIG. 18.

While the water supplying-ice separator 4050 is maintained in the discharge-restricting state, the ice-making water discharged to the ice making container 4010 may be cooled and frozen into ice.

As described above, the discharging state and the discharge-restricting state of the water supplying-ice separator 4050 may be simply adjusted via the rotation of the water supplying-ice separator 4050.

Figure 14:
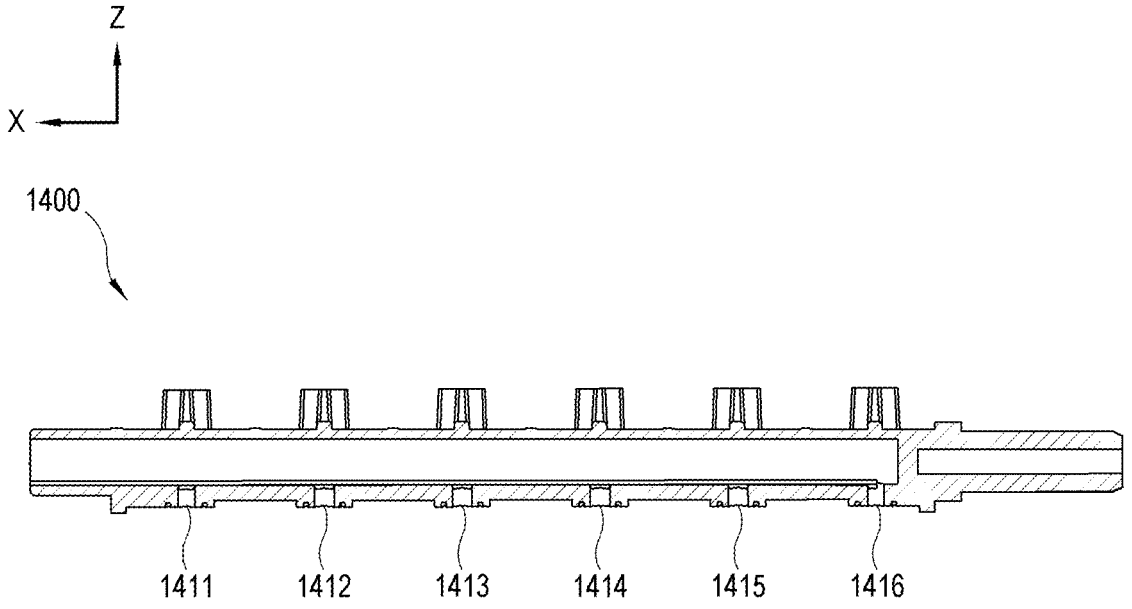
FIG. 14 illustrates a section view of a water supplying-ice separator according to another embodiment of the disclosure.

FIG. 14 illustrates a section view of a water supplying-ice separator according to another embodiment of the disclosure. The outlets 4054 of the water supplying-ice separator 4050 may be different in size (see reference numeral 1400). The number of the outlets 4054 is not limited to the drawing.

The outlets 4054 of the water supplying-ice separator 4050 may be provided to be the same in size, and may be provided to be different from one another in size. Also, the outlets 4054 of the water supplying-ice separator 4050 may be provided to be different from one another in size, so that an amount of the ice-making water discharged to the ice making container 4010 from the outlets 4054 is adjusted to be the same. If the outlets 4054 of the water supplying-ice separator 4050 are provided to be the same in size, an amount of the ice-making water discharged from the outlets 4054 may be different according to a location of the outlets 4054 in the water passage 4053, such as an upstream region or a downstream region. Accordingly, to make an amount of the ice-making water discharged from each of the outlets 4054 to be uniform, the outlets 4054 may be different in size. As a specific example, an outlet 1411 located in the upstream region and an outlet 1416 located in the downstream region in the water passage 4053 may be provided to have a size smaller than other outlets 1412 to 1415. Or, an outlet 1413 located in a midstream region in the water passage 4053 may be provided to have a size larger than other outlets.

Figure 15:
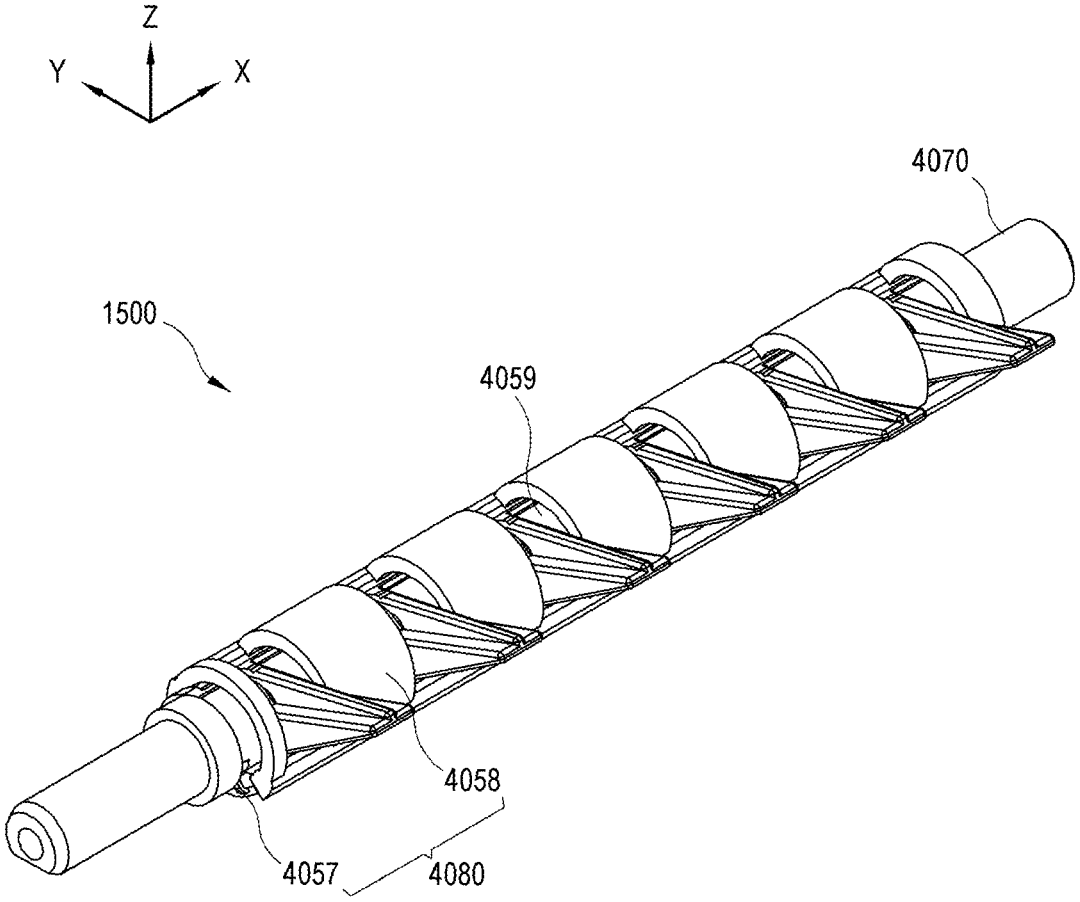
FIGS. 15 and 16 illustrate perspective views of a water supplying-ice separator according to an embodiment of the disclosure.
Figure 16:
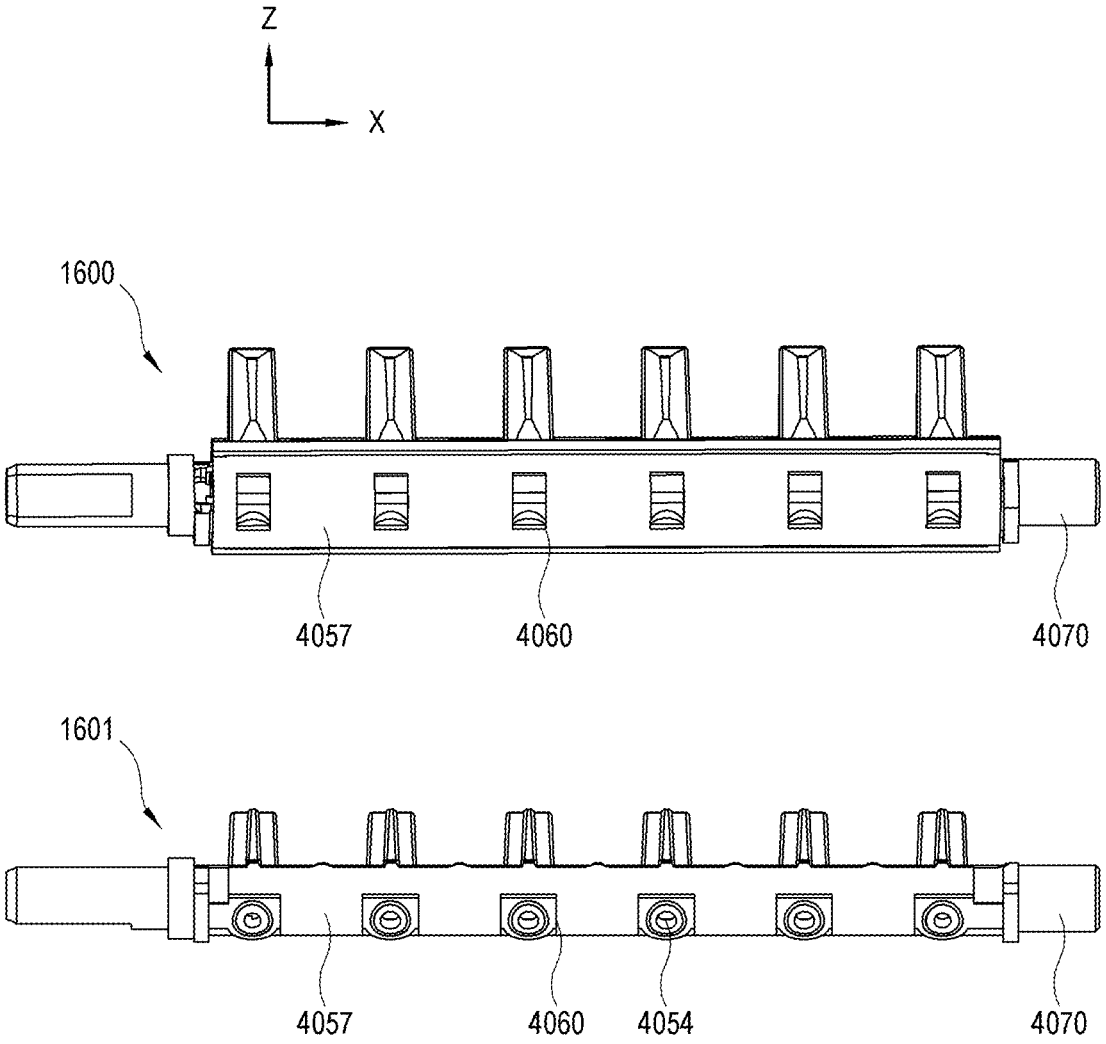

As an additional embodiment with respect to the water supplying-ice separator 4050 explained with reference to FIGS. 4 to 14, below, a water supplying-ice separator in which a water supplying cover is provided is described. FIGS. 15 and 16 illustrate perspective views of a water supplying-ice separator according to an embodiment of the disclosure. The water supplying-ice separator 4050 shown in FIGS. 15 and 16 further includes a water supplying cover 4080. The water supplying cover 4080 may include a lower water supplying cover 4057 and an upper water supplying cover 4058. FIGS. 15 and 16 shows the lower water supplying cover 4057 and the upper water supplying cover 4058, respectively. The lower water supplying cover 4057 and the upper water supplying cover 4058 may be provided to wrap around an outer circumference of the water supplying shaft 4070.

In the upper water supplying cover 4058 may be provided a plurality of upper openings 4059 corresponding to a position of the plurality of ice separating rods 4052. The ice separating rods 4052 may be protruded outside the upper water supplying cover 4058 through the upper openings 4059.

The upper openings 4059 of the upper water supplying cover 4058 may be provided, so that the upper water supplying cover 4058 rotates or not with the ice separating rods 4052 according to the rotation angle of the water supplying-ice separator 4050. For example, when the rotation angle of the water supplying-ice separator 4050 is within a given range of angle around the rotation shaft of the water supplying-ice separator 4050, the upper openings 4059 may be provided, so that the upper water supplying cover 4058 maintains its position state regardless of the movement of the ice separating rods 4052. When the rotation angle of the water supplying-ice separator 4050 is out of the given range of angle, the upper openings 4059 may be provided, so that the upper water supplying cover 4058 rotates together with the rotation the ice separating rods 4052.

The lower water supplying cover 4057 may be provided closer to the water supplying shaft 4070 than the upper water supplying cover 4058, and combined with the upper water supplying cover 4058. The lower water supplying cover 4057 may be disposed to wrap around the outlets 4054.

The water supplying cover 4080 provided in the outlets 4054 may rotate by the rotation of the water supplying-ice separator 4050, thereby determining whether to or not discharge the ice-making water. Or, the water supplying cover 4080 may determine whether to or not discharge the ice-making water not by the rotation of the water supplying-ice separator 4050, but by a separately provided power transmitting device (not shown).

The controller 300 may supply the ice-making water to the water supplying-ice separator 4050 from the water supply 303. Since in the general mode for making the general ice, the outlets 4054 may be in a state opened by the water supplying cover 4080, the supplied ice-making water may be directly discharged to the ice making container 4010 from the water supplying-ice separator 4050.

In the transparent mode for making the transparent ice, the outlets 4054 may be in a state closed by the water supplying cover 4080. After the ice-making water has been supplied to the water supplying-ice separator 4050, the controller 300 may rotate the water supplying cover 4080 to discharge the ice-making water to ice making container 4010.

Figure 17:
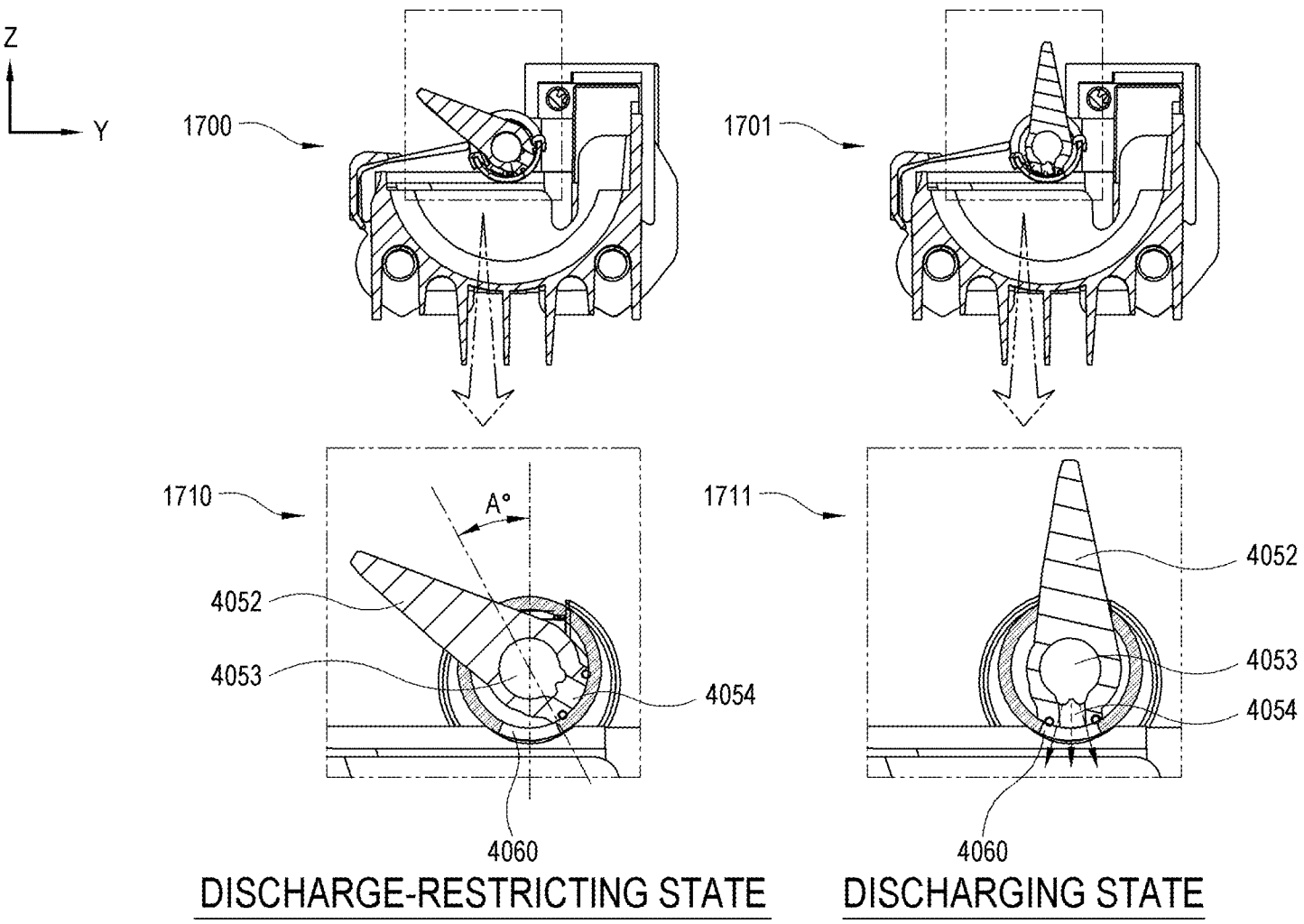
FIG. 17 illustrates section views of a water supplying-ice separator shown in FIGS. 15 and 16, according to an embodiment of the disclosure.

FIG. 17 illustrates section views of the water supplying-ice separator shown in FIGS. 15 and 16, according to an embodiment of the disclosure. The lower water supplying cover 4057 may be provided to rotate or not with the upper water supplying cover 4058 according to the rotation of the upper water supplying cover 4058. For example, in a given section among a rotating section of the upper water supplying cover 4058, the lower water supplying cover 4057 may maintain its position state regardless of the upper water supplying cover 4058. In a section out of the given section among the rotating section of the upper water supplying cover 4058, the lower water supplying cover 4057 may be provided to rotate with the rotation of the upper water supplying cover 4058.

In the lower water supplying cover 4057 may be provided lower openings 4060. The lower openings 4060 may open up or shut off the outlets 4054 to or from the outside according to the rotation of the water supplying-ice separator 4050.

According to the rotation of the lower water supplying cover 4057, the lower openings 4060 may be located on a lower side of the water supplying-ice separator 4050, which is a discharge-restricting state (see reference numeral 1700). In this case, the outlets 4054 may be provided to be shut off from the outside since the lower openings 4060 are not coincided with the outlets 4054 in location, so that the ice-making water in the water passage 4053 is not discharged (see reference numeral 1710). According to this, even though the rotation angle of the water supplying-ice separator 4050 is in a state smaller than the discharge-restricting angle, the outlets 4054 may not be opened by the lower water supplying cover 4057, thereby maintaining the water supplying-ice separator 4050 in the discharge-restricting state.

In contrast, according to the rotation of the lower water supplying cover 4057, the lower openings 4060 may be located on a lower side of the water supplying-ice separator 4050, which is a water supplying state (see reference numeral 1701). In this case, the outlets 4054 may be provided to be opened up to the outside since the lower openings 4060 are coincided with the outlets 4054 in location, so that the ice-making water in the water passage 4053 is discharged (see reference numeral 1711). According to this, the water supplying-ice separator 4050 may come to the water supplying state.

Since a boundary between the discharging state (i.e., the water supplying state) and the discharge-restricting state of the water supplying-ice separator 4050 is clearly defined by the water supplying cover 4080, a relatively accurate control to the discharged amount of the ice-making water may be possible. Also, the water supplying cover 4080 may block a communication of the water passage 4053 with the outside of the water supplying-ice separator 4050 in the discharge-restricting state, thereby preventing the ice-making water remained in the water passage 4053 from being made into ice.

As an additional embodiment, a heater may be provided in the water supplying cover 4080. The heater may melt ice, which is made by cool air and which is in contact with the water supplying cover 4080. With this, a malfunction of the water supplying-ice separator 4050 due to the ice, which is in contact with the water supplying cover 4080, may be prevented.

Figure 18:
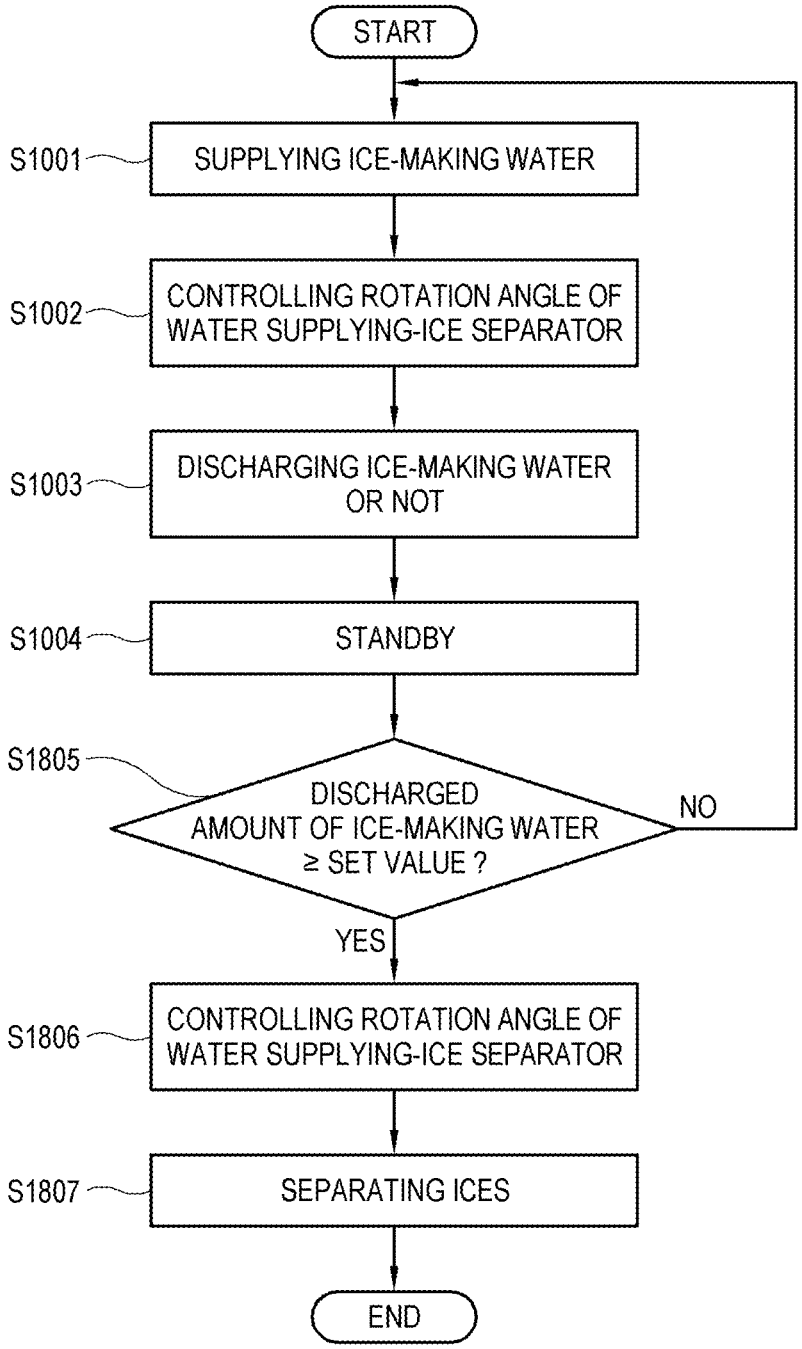
FIG. 18 illustrates a flowchart showing an ice making process, which is carried out by an ice making unit according to another embodiment of the disclosure.

FIG. 18 illustrates a flowchart showing an ice making process, which is carried out by an ice making unit according to another embodiment of the disclosure. In explanations on the ice making process of FIG. 18, operations as identical to or similar with those in the ice making unit explained with reference to FIGS. 10 to 13 will be omitted. Operations S1001 to S1004 are similar with those in FIG. 9.

The controller 300 according to the present embodiment may control the driver 301 to adjust times during which the water supplying-ice separator 4050 is maintained in the discharging state and the discharge-restricting state, thereby adjusting an amount of the ice-making water discharged to the ice making container 4010 from the water supplying-ice separator 4050.

To be more specific, the controller 300 may calculate an amount of the discharged ice-making water and compare the calculated discharged amount with a preset value (operation S1805). If the amount of the discharged ice-making water is equal to or more than the preset value ('YES' in operation S1805), the controller 300 may control the water supplying-ice separator 4050 to no longer discharge the ice-making water, but to rotate the water supplying-ice separator 4050 (operation S1806). As the water supplying-ice separator 4050 rotates, the ice separating rods 4052 may separate the made ice to eject from the ice making container 4010. Prior to rotating the water supplying-ice separator 4050, the controller 300 may operate the heater to easily separate the ice.

If the amount of the discharged ice-making water is less than the preset value ('NO' in operation S1805), the water supply 303 may further supply the ice-making water according to a control of the controller 300, thereby increasing the amount of the ice-making water accommodated in the water passage 4053 (operation S1001). Or, if the amount of the ice-making water accommodated in the water passage 4053 is equal to or more than a given amount, the water supply 303 may omit the water supplying operation (operation S1001) according to a control of the controller 300. If the ice-making water is supplied (operation S1001), the controller 300 may control respective elements of the ice making unit 100 to carry out a series of operations (operations S1001 to S1004) as described earlier.

As described above, by using the driver 301, the controller 300 may control the times during which the water supplying-ice separator 4050 is maintained in the discharging state and the discharge-restricting state, and control the number of times discharging the ice-making water and the amount of the ice-making water being discharged once. With this, the ice-making water may be discharged on the ice made in the lower side of the ice making container 4010, and the discharged ice-making water may be frozen into ice. If the ice-making water is frozen into ice, the controller 300 may control the respective elements of the ice making unit 100 to repeat the process as described above, thereby allowing the ice to be made from the lower side of the ice making container 4010. As the ice is made from the lower side of the ice making container 4010, air bubbles included in the ice-making water being frozen may be discharged out of the outside and thus the made ice may have increased transparency. If the controller 300 controls to reduce the amount of the ice-making water being discharged once and to increase the number of times discharging the ice-making water, the made ice may have increased transparency. The controller 300 may control to adjust the number of times discharging the ice-making water and the amount of the ice-making water being discharged once, thereby making ice having transparency a user want. Accordingly, if the user wants a general ice, the controller 300 controls to increase the amount of the ice-making water being discharged once thus to make the general ice. In contrast, if the user wants a transparent ice, the controller 300 controls to reduce the amount of the ice-making water being discharged once and increase the number of times discharging the ice-making water thus to make the ice having increased transparency.

FIGS. 19 to 22 show position of the outlets 4054 according to the rotation angle of the water supplying-ice separator 4050.

Figure 19:
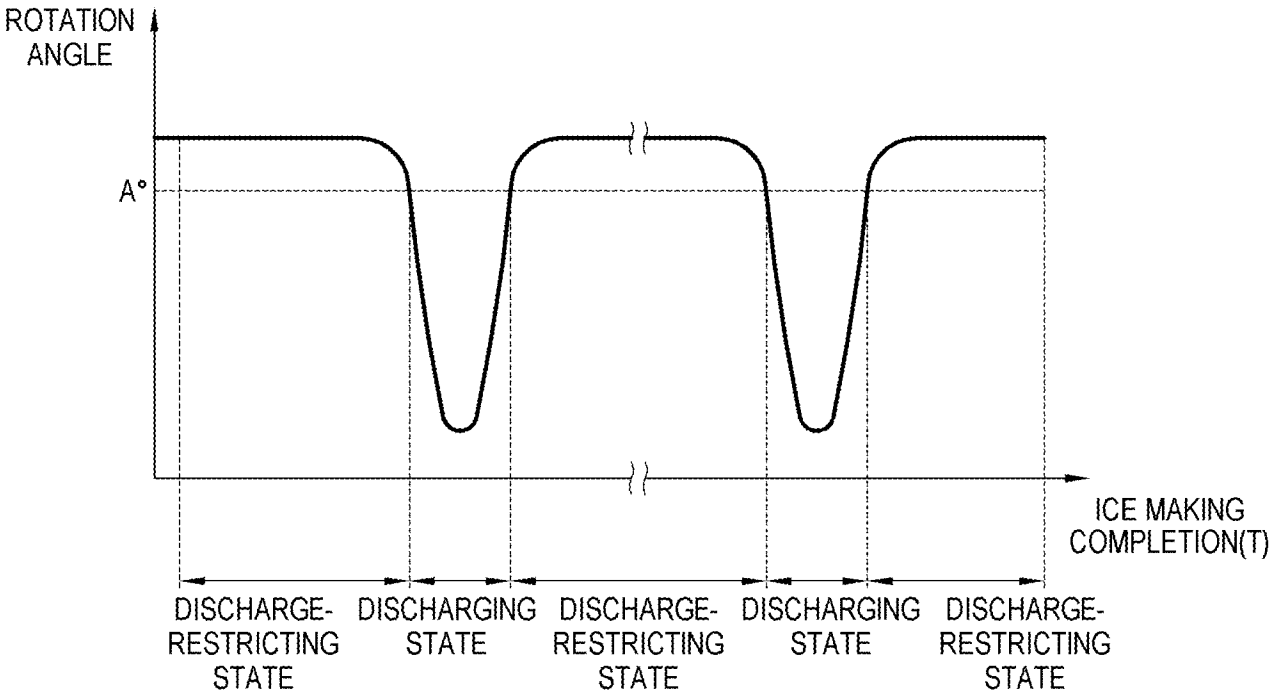
FIG. 19 illustrates a graph showing a time and an angle of outlets according to an embodiment of the disclosure.

FIG. 19 illustrates a graph showing a time and an angle of the outlets according to an embodiment of the disclosure. In explanations of FIG. 19, portions identical to or similar with those explained with reference to FIG. 13 will be omitted.

In FIG. 19, as explained below, a discharging state of the water supplying-ice separator 4050 may occur several times until a time T where the ice making is completed.

In a discharge-restricting state between the continuous discharging states, the discharged ice-making water may be frozen into ice. After the discharged ice-making water is frozen into ice in the discharge-restricting state, the controller 300 may control the water supplying-ice separator 4050 to be changed into the discharging state. If there is a large amount of discharged ice-making water in the discharging state, the controller 300 may control to increase a time that the discharge-restricting state is maintained. In the graph of FIG. 19, the discharging state occurs two times, but this is only for convenience in explanation and the number of times and the maintaining time of the discharging state are not limited thereto.

Below, position of the outlets according to the rotation angle of the water supplying-ice separator 4050 is described.

Figure 20:
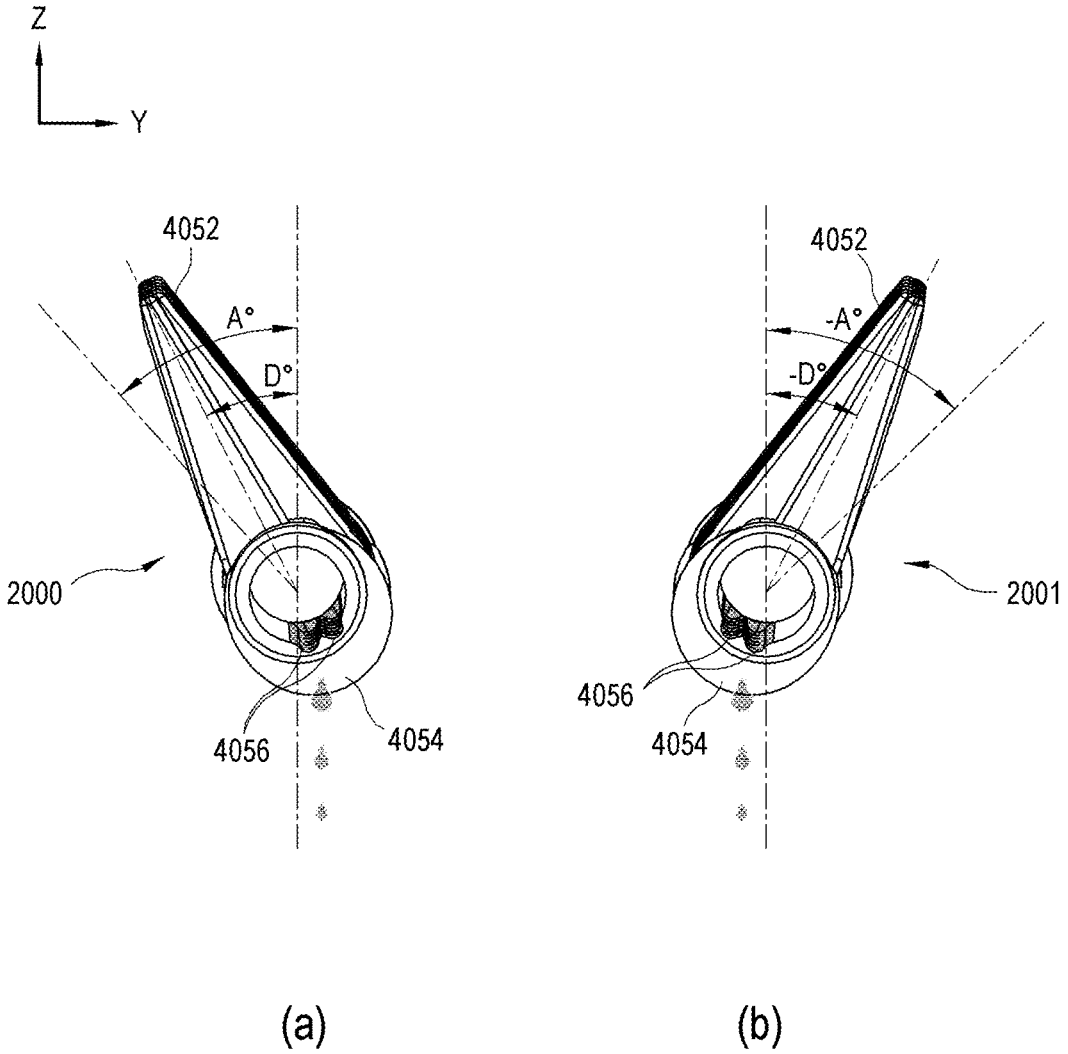
FIG. 20 illustrates a section view of a water supplying-ice separator according to other embodiment of the disclosure.

FIG. 20 illustrates a section view of the water supplying-ice separator according to another embodiment. In the discharging states, the controller 300 may control the rotation angle of the water supplying-ice separator 4050 to be different each other. As the rotation angle of the water supplying-ice separator 4050 is controlled to be different each other as D° and −D° in the discharging states, the position of the outlets 4054 may be varied (see reference numerals 2000 and 2001). D is a value smaller than a discharging limit angle A°. As the position of the outlets 4054 is varied, a position where the ice-making water comes in contact with the ice making container 4010 may be varied. According to this, the ice-making water may be evenly discharged without being concentrated in a position of the ice making container 4010. As the ice-making water is evenly spread out and frozen into ice, the made ice may be varied in shape. Or, in the discharging states, the controller 300 may control the rotation angle of the water supplying-ice separator 4050 in a certain angle, thereby discharging the ice-making water to be concentrated in a position of the ice making container 4010.

Figure 21:
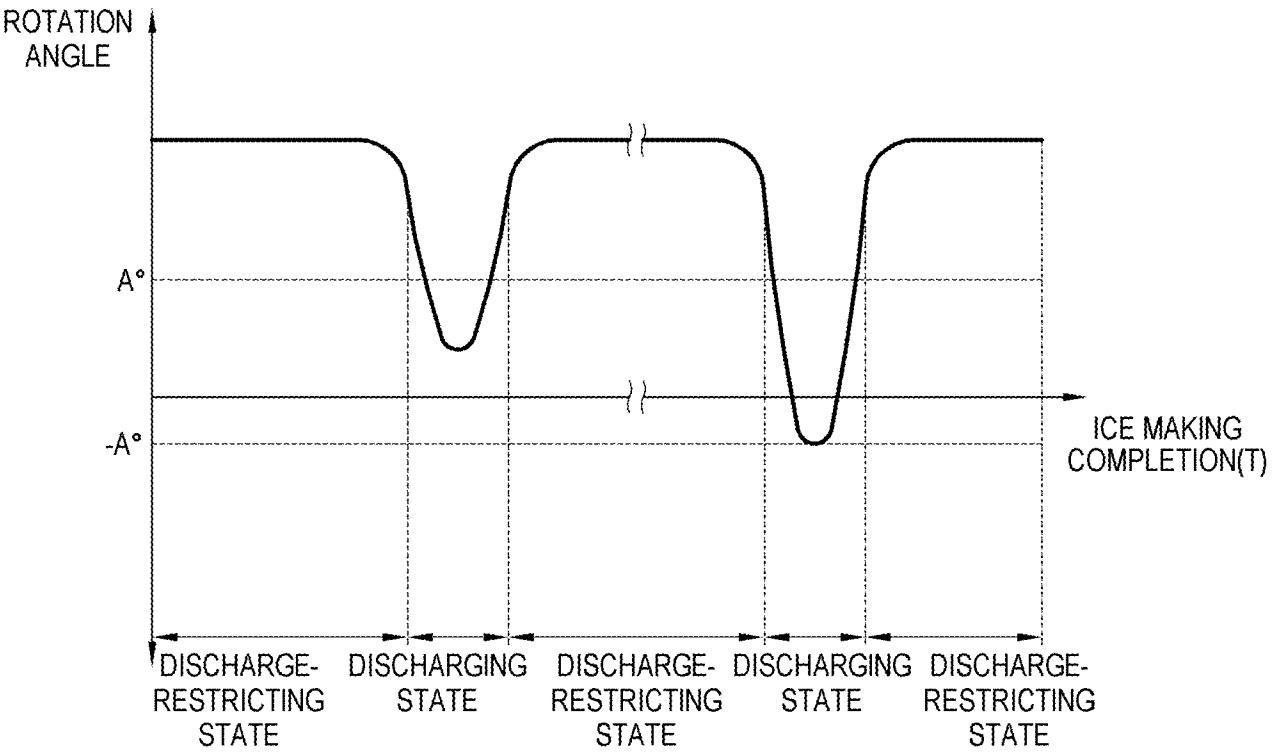
FIG. 21 illustrates a graph showing a time and an angle of outlets according to another embodiment of the disclosure.

FIG. 21 illustrates a graph showing a time and an angle of the outlets according to further embodiment. In explanations of FIG. 21, portions on the graph identical to or similar with those explained with reference to FIGS. 13 and 19 will be omitted.

According to a control of the controller 300, the driver 301 may rotate the water supplying-ice separator 4050, so that the rotation angle of the water supplying-ice separator 4050 comes to more than 0° and less than A°, thereby changing the water supplying-ice separator 4050 from the discharge-restricting state to the discharging state (see reference numeral 2000). In the discharging state, the ice-making water may be discharged to a first position of the ice making container 4010. Or, the controller 300 may control the driver 301, so that the rotation angle of the water supplying-ice separator 4050 comes to less than 0° and more than −A°, thereby changing the water supplying-ice separator 4050 to the discharging state. According to this, the ice-making water may be discharged to a second position different from the first position of the ice making container 4010 (see reference numeral 2001).

Figure 22:
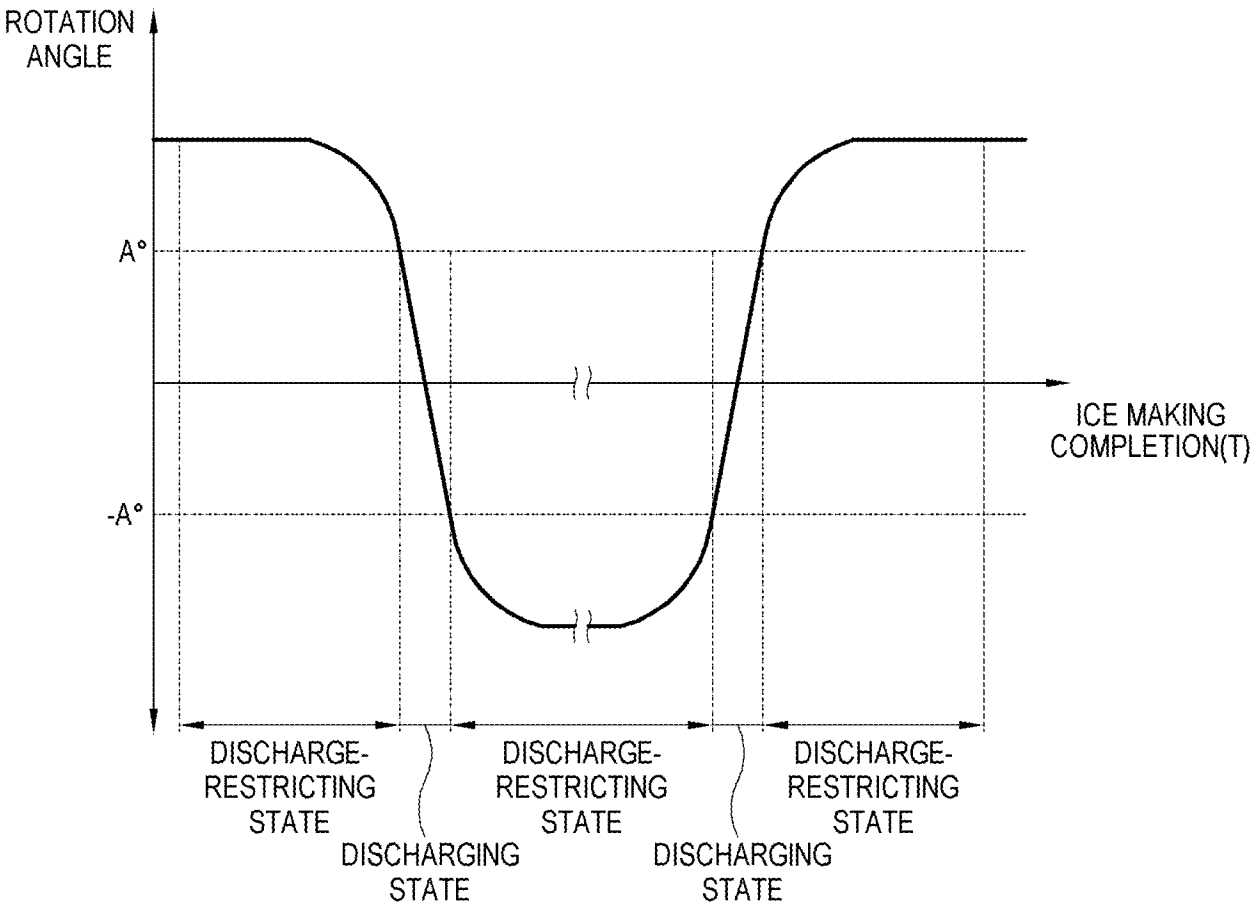
FIG. 22 illustrates a graph showing a time and an angle of outlets according to other embodiment of the disclosure.

FIG. 22 illustrates a graph showing a time and an angle of the outlets according to another embodiment. In explanations of FIG. 22, portions on the graph identical to or similar with those explained with reference to FIGS. 13, 19 and 21 will be omitted.

The controller 300 may control to rotate the water supplying-ice separator 4050, thereby controlling the water supplying-ice separator 4050 so that the rotation angle of the water supplying-ice separator 4050 is within a range of −A°~A°. Accordingly, the water supplying-ice separator 4050 may come to the discharging state. If controlling the state of the water supplying-ice separator 4050 in the discharge-restricting state, the controller may control the rotation angle of the water supplying-ice separator 4050 to come not to be equal to or more than A°, but less than −A°. According to this, the ice-making water may be more evenly discharged.

A described above, according to the embodiments of the disclosure, the ice maker may form a single ice-making direction toward the upper side of the ice making container form the inner circumference surface thereof, thereby making the ice having increased transparency.

Further, according to the embodiments, the ice maker may adjust the water supplying period or the water supplying amount to make the ice having transparency the user wants.

Furthermore, according to the embodiments, the ice maker may be simplified in structure.

Also, according to the embodiments, the ice maker may reduce energy consumption.

Also, according to the embodiments, the ice maker may make homogeneous ices.

Although a few embodiments have been described in detail, the present inventive concept is not limited to these embodiments and various changes may be made without departing from the scope defined in the appended claims.

Although the present disclosure has been described with various embodiments, various changes and modifications may be suggested to one skilled in the art. It is intended that the present disclosure encompass such changes and modifications as fall within the scope of the appended claims.

What is claimed is:

1. An ice maker of a refrigerator comprising:

a water supply configured to supply an ice-making water;

an ice making container configured to hold the ice-making water supplied by the water supply;

a cooler configured to provide a chill to the ice-making water in the ice making container to cool the ice-making water;

a water supplying-ice separator comprising:

a water supplying shaft including a water passage therein and a plurality of outlets, wherein the ice-making water supplied from the water supply enters into the water passage and is discharged through the plurality of outlets to the ice making container, and at least one ice separating rod provided on the water supplying shaft to separate a made ice from the ice making container by a rotation of the water supplying-ice separator;

a driver configured to rotate the water supplying-ice separator; and a controller configured to:

perform a control operation in a first mode for making ice with a first transparency or in a second mode for making ice with a second transparency higher than the first transparency, and based on the second mode being selected:

control the driver to repeat a discharging state to discharge the ice-making water accommodated in the water passage and a discharge-restricting state not to discharge the ice-making water accommodated in the water passage, and control an amount of the ice-making water discharged at each discharging state to make ice having the second transparency.

2. The ice maker according to claim 1, wherein the controller is further configured to:

control the driver to repeat the discharging state, when a rotation angle of the plurality of outlets by the rotation of the water supplying-ice separator is less than a given angle from a center of the ice making container; and control the driver to prevent the ice-making water from being discharged in the discharge-restricting state where the rotation angle of the plurality of outlets by the rotation of the water supplying-ice separator is equal to or more than the given angle from the center of the ice making container.

3. The ice maker according to claim 1, wherein the controller is further configured to, based on the second mode being selected, reduce the amount of ice-making water discharged and increase a discharging number of times of ice-making water discharged thereto to make ice having the second transparency.

4. The ice maker according to claim 1, wherein the controller is further configured to:

control the driver to drive the water supplying-ice separator in the discharging state and the discharge-restricting state according to a water level of the ice-making water in the water passage.

5. The ice maker according to claim 1, wherein the controller is further configured to:

control the driver to change a falling position of the ice-making water that is discharged by changing a position of the plurality of outlets.

6. The ice maker according to claim 1, wherein:

the driver is engaged with the water supplying shaft of the water supplying-ice separator to rotate the water supplying-ice separator, and the at least one ice separating rod provided on the water supplying shaft separates the made ice from the ice making container by the rotation of the water supplying shaft of the water supplying-ice separator.

7. The ice maker according to claim 1, wherein:

the ice making container comprises a plurality of cells arranged in a given direction, the water supplying shaft is configured to be formed in a cylindrical form extended along the given direction of the plurality of cells at an upper side of the ice making container, and the plurality of outlets is configured to be provided in positions corresponding to the plurality of cells, so that the ice-making water is discharged to the plurality of cells, respectively.

8. The ice maker according to claim 7, wherein:

the at least one ice separating rod comprises a plurality of ice separating rods formed in a number corresponding to the plurality of cells, to project from an outer circumference surface of a cylinder of the water supplying shaft in positions corresponding to the plurality of cells, respectively.

9. The ice maker according to claim 1, wherein among the plurality of outlets, outlets located at an upstream side of the water passage are configured to be smaller in size than outlets located at another side of the water passage.

10. The ice maker according to claim 1, wherein among the plurality of outlets, outlets located at end sides of the water passage are configured to be smaller in size than outlets located at a center side of the water passage.

11. The ice maker according to claim 1, wherein a water supplying cover is provided on the outlets and configured to control whether the ice-making water is discharged.

12. The ice maker according to claim 11, further comprising a heater configured to supply heat to the water supplying cover.

13. The ice maker according to claim 1, further comprising a heater configured to supply heat to the ice making container.

14. The ice maker according to claim 1, further comprising a space configured to accommodate the ice-making water entering into the water passage.

15. A control method of an ice maker in a refrigerator comprising:

supplying an ice-making water from a water supply;

filling an ice making container with the ice-making water supplied by the water supply;

providing a chill to the ice-making water filled in the ice making container to cool the ice-making water; and rotating a water supplying-ice separator by a driver, the water supplying-ice separator comprising a water supplying shaft including a water passage therein and a plurality of outlets and at least one ice separating rod, wherein the ice-making water supplied from the water supply enters into the water passage and the ice-making water is discharged through the plurality of outlets to the ice making container, and wherein the at least one ice separating rod is provided on the water supplying shaft and separates a made ice from the ice making container by the rotation of the water supplying-ice separator, and wherein the ice maker is configured to perform a control operation in a first mode for making ice with a first transparency or in a second mode for making ice with a second transparency higher than the first transparency, and wherein the rotating the water supplying-ice separator comprises, based on the second mode being selected, controlling the driver to repeat a discharging state to discharge the ice-making water accommodated in the water passage and a discharge-restricting state not to discharge the ice-making water accommodated in the water passage and to control an amount of the ice-making water discharged at each discharging state to make ice having the second transparency.

16. The control method according to claim 15, wherein the rotating the water supplying-ice separator further comprises:

controlling the driver to repeat the discharging state to discharge the ice-making water when a rotation angle of the plurality of outlets by the rotation of the water supplying-ice separator is less than a given angle from a center of the ice making container; and controlling the driver to prevent the ice-making water from being discharged in the discharge-restricting state where the rotation angle of the plurality of outlets by the rotation of the water supplying-ice separator is equal to or more than the given angle from the center of the ice making container.

17. The control method according to claim 16, wherein controlling the driver further comprises, based on the second mode being selected, reducing the amount of ice-making water discharged and increasing a discharging number of times of ice-making water discharged thereto to make ice having the second transparency.

18. The control method according to claim 16, wherein controlling the driver further comprises:

controlling the driver to drive the water supplying-ice separator in the discharging state and the discharge-restricting state according to a water level of the ice-making water in the water passage.

19. The control method according to claim 16, wherein controlling the driver further comprises:

controlling the driver to change a falling position of the ice-making water that is discharged by changing a position of the plurality of outlets.

20. The control method according to claim 15, further comprising supplying, by a heater, heat to at least one of:

a water supplying cover provided on the outlets to control whether the ice-making water is discharged, or the ice making container.

* * * * *